US010221580B2

(12) United States Patent
Connors

(10) Patent No.: US 10,221,580 B2
(45) Date of Patent: Mar. 5, 2019

(54) MODULAR WALL SYSTEM FOR EXHIBITION BOOTHS

(71) Applicant: GLENMORE INDUSTRIES LLC, Edison, NJ (US)

(72) Inventor: Patrick Connors, Boynton Beach, FL (US)

(73) Assignee: GLENMORE INDUSTRIES LLC, Edison, NJ (US)

( * ) Notice: Subject to any disclaimer, the term of this patent is extended or adjusted under 35 U.S.C. 154(b) by 0 days.

(21) Appl. No.: 14/870,729

(22) Filed: Sep. 30, 2015

(65) Prior Publication Data

US 2016/0017620 A1 Jan. 21, 2016

Related U.S. Application Data

(63) Continuation of application No. 14/097,899, filed on Dec. 5, 2013, now Pat. No. 9,194,142.
(Continued)

(51) Int. Cl.
*A47F 10/00* (2006.01)
*E04H 1/12* (2006.01)
(Continued)

(52) U.S. Cl.
CPC ..... *E04H 1/1272* (2013.01); *E04B 2/7437* (2013.01); *E04H 15/30* (2013.01);
(Continued)

(58) Field of Classification Search
CPC ..... B60N 2/1615; B60N 2/68; B60N 2/165; B60N 2/16; B60N 2/684; B60N 2/682;
(Continued)

(56) References Cited

U.S. PATENT DOCUMENTS 2,925,916 A * 2/1960 Pollock ..... A47B 61/02 211/119.004
3,326,505 A * 6/1967 Jamar, Jr. ..... E04B 2/7425 211/189
(Continued)

FOREIGN PATENT DOCUMENTS

CA 2161459 A1 4/1997
DE 10326196 B3 11/2004
(Continued)

*Primary Examiner* — Chi Q Nguyen
(74) *Attorney, Agent, or Firm* — Robert L. Epstein; Epstein Drangel LLP

(57) ABSTRACT

A modular wall system for use in trade shows includes a wall or header panel formed of frame parts, and a connecting bracket for detachably connecting the end of the panel to an upstanding column. Perpendicular sections of a corner connector are received in the hollow end of different ones of the frame parts to connect the frame parts. A fabric cover defines a recess with an open end adapted to receive the frame parts. A closure device is provided for at least partially closing the open end of the fabric cover. A vertical support member extends from the frame parts to a surface to transmit the weight of an accessory to the surface. The accessory may be an adjustable garment rack, a coupling grid, a shelving unit, or a peg-board unit and a hook. The system includes a crate adapted to receive a plurality of members for transport.

10 Claims, 33 Drawing Sheets

Related U.S. Application Data

(60) Provisional application No. 61/830,935, filed on Jun. 4, 2013.

(51) Int. Cl.

| | |
|---|---|
| ***E04H 15/30*** | (2006.01) |
| ***E04H 15/34*** | (2006.01) |
| ***E04H 15/54*** | (2006.01) |
| ***E04B 2/74*** | (2006.01) |
| *E04B 1/61* | (2006.01) |
| *E04B 2/76* | (2006.01) |
| *E04B 2/78* | (2006.01) |

(52) U.S. Cl.
CPC ..... *E04H 15/34* (2013.01); *E04H 15/54* (2013.01); *E04B 1/612* (2013.01); *E04B 1/6108* (2013.01); *E04B 1/6116* (2013.01); *E04B 1/6125* (2013.01); *E04B 1/6137* (2013.01); *E04B 1/6145* (2013.01); *E04B 1/6158* (2013.01); *E04B 2/761* (2013.01); *E04B 2/7827* (2013.01); *E04B 2002/7418* (2013.01); *E04B 2002/7446* (2013.01); *E04B 2002/7479* (2013.01); *E04B 2002/7483* (2013.01)

(58) Field of Classification Search
CPC ..... E04B 2/7473; E04B 2/7438; E04B 2/76; E04B 2/761; E04B 2002/7418; E04B 2002/7446; E04B 2002/7679; E04H 1/1272; E04H 15/32; E04H 15/42; E04H 15/34
USPC ..... 297/344.15, 311, 313, 331, 452.18, 353, 297/354.1, 301.1, 216.19, 321; 296/65.05; 52/36.1, 202, 506.03, 36.5, 52/36.4, 278, 563, 578, 582.1; 135/121, 135/120.3
See application file for complete search history.

(56) References Cited

U.S. PATENT DOCUMENTS 3,889,736 A * 6/1975 Firks ..... A47G 5/00 16/225
3,949,827 A 4/1976 Witherspoon
4,239,170 A * 12/1980 Planebo ..... A47B 97/001 248/447.1
4,846,430 A * 7/1989 Ke ..... A47G 25/00 211/119.004
5,287,909 A * 2/1994 King ..... A47G 5/00 160/135
5,477,967 A * 12/1995 Voorhees ..... A47B 63/00 211/103
5,486,391 A * 1/1996 Tyner ..... B32B 5/18 160/135
D376,622 S * 12/1996 Roberts ..... D20/41
5,613,543 A * 3/1997 Walton ..... E04G 5/12 135/119
5,875,597 A * 3/1999 Gingrich ..... A47G 5/02 160/135
D511,258 S * 11/2005 Sandy ..... D6/332
7,178,769 B2 * 2/2007 Magnusson ..... A47B 96/1416 211/119.004
7,568,915 B1 * 8/2009 Lavoie ..... B43L 1/00 434/408
7,604,481 B2 * 10/2009 Owen ..... A47B 97/001 434/408
8,091,605 B1 * 1/2012 Melhart ..... G10K 11/20 160/135
8,641,007 B2 * 2/2014 Chen ..... A47B 97/001 211/71.01
8,713,857 B2 * 5/2014 Logue ..... A47B 46/005 160/200
8,870,148 B2 * 10/2014 Hickman ..... A47B 97/04 211/119.004
9,506,292 B2 * 11/2016 Levi ..... E06C 5/02
9,613,609 B2 * 4/2017 Caimi ..... G10K 11/168
2001/0054674 A1 * 12/2001 Turner ..... A47B 97/04 248/441.1
2003/0085188 A1 * 5/2003 Klein ..... A47B 57/10 211/118
2003/0182871 A1 10/2003 Gresham
2003/0182872 A1 10/2003 Gresham
2005/0145769 A1 * 7/2005 Ives ..... G09F 15/0087 248/447.1
2005/0191611 A1 * 9/2005 Owen ..... A47B 97/001 434/408
2009/0293391 A1 * 12/2009 DeVore ..... A47B 83/001 52/239
2010/0270246 A1 * 10/2010 Rodriguez ..... A47B 96/16 211/34

FOREIGN PATENT DOCUMENTS

EP 1288508 A1 3/2003
EP 1602838 A2 12/2005
TW M452682 U 5/2013

* cited by examiner

MODULAR WALL SYSTEM FOR EXHIBITION BOOTHS

CROSS-REFERENCE TO RELATED APPLICATION

This application is a continuation of U.S. patent application Ser. No. 14/097,899, filed Dec. 5, 2013, which claims the benefit of provisional patent application Ser. No. 61/830,935 filed in the United States Patent and Trademark Office on Jun. 4, 2013 and is incorporated in its entirety herein by reference.

BACKGROUND OF THE INVENTION

1. Field of the Invention

This invention relates generally to modular structures or petitions, and more particularly to a modular wall system for use in exhibitions, trade shows and the like configured for maximum design flexibility, ease of assembly and disassembly and simplicity in packing and shipping.

2. Description of the Related Art

Important features of display booths for exhibitors attending trade shows and exhibitions are display booth design flexibility, particularly with respect to the ability to create a large variety of different booth configurations and the ease of assembly and disassembly of the display booths. It is also important that the display booths have sufficient structural integrity to be used safely during the show and the ability to be transported efficiently between uses. Further, it is desirable that booth technologies offer a wide choice of new and useful accessories, which can be used to further customize the booths.

Standard wall systems for display booths feature either hard wall structures, or pipe and drape technologies. Hard wall systems require specialized assembly tools to open, close and/or adjust the components and are required to install accessories. Ladders are necessary to install the required top beams and headers of the system. Multiple sized crates are required for shipping and storing the system. Loading and unloading requires the use of dollies and overall the parts of the system are bulky and heavy making the components extremely difficult to pack, load and unload. In order for the system to provide custom designs, shop drawings are required.

Standard pipe and drape systems are advantageous over the hard wall systems in that they do not require specialized assembly tools. However, this type of pipe and drape system requires multiple spotting of the bases and posts. Shipping requires heavy carriers in various sizes, resulting in large cargo loads and high transportation costs. Moreover, the pipe and drape type systems do not provide for accessories and have shown to be very unstable.

It is, therefore, a primary object of the present invention to provide a modular wall system for use in exhibitions, trade shows and the like configured for maximum design flexibility, ease of assembly and disassembly, and for simplicity in packing and shipping.

It is another object of the present invention to provide a modular wall system for creating various uniquely designed exhibition booths one or more stories high utilizing only three main parts including columns, wall panels and headers.

It is another object of the present invention to provide a uniquely structured interengageable and detachable connecting means for securing wall panels and headers to columns without the need for assembly tools.

It is another object of the present invention to provide a universal column structure interengageable with wall panels and headers to create a large variety of different booth configurations, designed for multiple side use and extending one or more stories in height.

It is another object of the present invention to provide a unique fabric covering for the wall panels and headers, separated on both sides to eliminate shadows created by objects hanging within the booth.

It is another object of the present invention to provide a fabric covering having a zipper and stretchable fabric making it easy to replace, remove and re-install over the panels.

It is another object of the present invention to provide a fabric covering that stretches over the frame members of the wall panel and makes it easy to adjust and manipulate the covering and frame members underneath.

It is another object of the present invention to provide a modular wall system, which can be reconfigured for on-site design modifications in a quick and efficient manner.

It is another object of the present invention to provide a carrier for the modular wall system designed to be stored during transportation to maximize truck cargo space while decreasing loading and reloading time at events.

It is another object of the present invention to provide a carrier that is easily delivered to the show room floor and efficiently transported up and down the show room aisles before assembling and after dismantling of the booth.

It is another object of the present invention to provide wheeled carriers specially designed for uniquely stacking columns therein.

It is another object of the present invention to provide wheeled carriers specially designed for uniquely stacking headers therein.

It is another object of the present invention to provide wheeled carriers specially designed for uniquely stacking wall panels therein.

It is another object of the present invention to provide means for concealing electrical wires within the modular system.

It is another object of the present invention to provide a modular wall system including a variety of interengageable accessories for displaying products in an esthetically pleasing and professional manner.

BRIEF SUMMARY OF THE INVENTION

In accordance with one aspect of the present invention, a modular system is provided having an upstanding column having a surface, a member having an end and means for detachably connecting the end of the member and the column. The connecting means includes first and second interengageable parts. The first part is attached to one of the surface of the column and the member and includes a slot extending in a direction along the length of the surface of the column. The slot includes opposing outwardly inclined sides. The second part is attached to the other of the column and the member. The second part includes opposing sides correspondingly shaped with the slot sides and is received within the slot to connect the end of the member and the column.

The slot may be substantially "U" shaped. The member may include a panel with a frame and a fabric cover defining a recess with an open end adapted to receive the frame. The frame may include first and second frame parts and a corner connector connecting the frame members. The connector may include first and second substantially perpendicular sections, each of the sections adapted to engage a different one of the frame parts. The frame parts may be hollow and the connector sections are received within the frame parts, respectively. The member may include a wall or a header.

The system may further include a crate adapted to receive a plurality of the members in side-by-side relation and may include wheels. The system may further include a crate adapted to receive a plurality of columns in side-by-side stacked relation and may include wheels. The system may further include a structural part for detachably stacking one upright column above another column.

The system may further include an adjustable garment rack interengageable with the frame parts. The system may further include a coupling grid interengageable with the frame parts. The system may further include a shelving unit interengageable with the frame parts. The system may further include a peg-board unit interengageable with the frame parts. The system may further include a hook interengageable with the frame parts.

The system may further include a support adapted to extend between the columns and means for detachably connecting the end of the support to a surface of the column. The support connecting means may include first and second interengageable parts. The first part may be attached to one of the surface of the column and the support and include a slot extending in a direction along the length of the surface of the column. The slot may include opposing outwardly inclined sides. The second part may be attached to the other of the surface of the column and the support. The second part may include opposing sides correspondingly shaped with the slot sides, and adapted to be received within the slot sides and received within the slot to connected the end of the support and the column.

Each end of the support may be connected to a different one of the columns. Each of the columns may be connected to one or more members. The support may be hollow and the second part of the support connecting means may be received within the support. Each of the columns may be connected to one or more of the supports.

The system may further include means for concealing electrical wires within the system. The concealing means includes an elongated casing having an interior channel interengageable with the member or the column.

In accordance with an additional embodiment, a modular system is provided having an upstanding column and a member attached to the column. The member includes a frame. The frame includes first and second frame parts and a corner connector connecting the frame parts. The corner connector includes first and second substantially perpendicular sections. Each of the sections is adapted to engage a different one of the frame parts.

The frame parts are hollow and the connector sections are adapted to be received within different ones of the frame parts. The system may further include means for detachably connecting the column and the member. The system may further include means for detachably connecting the column in vertical alignment with another column. The frame parts may be formed of extruded aluminum. The connector may be formed of plastic. The member may include a wall or header.

In accordance with an additional embodiment, a modular system is provided having an upstanding column and a member attached to the column. The member includes a frame and a fabric cover defining a recess with an open end adapted to receive the frame. The fabric cover includes means for at least partially closing the open end of the fabric cover.

The system may further include means for connecting the column and the member, wherein the connecting means extends through the open end of the fabric cover. The closing means may include a zipper or hook and loop fastener sections. The member may include a wall or header. The fabric cover may include stretch double interlock knit fabric. The frame may include extruded aluminum members.

In accordance with an additional embodiment, a bracket assembly is provided for detachably connecting parts of a modular wall system. The system includes a member having an end and a column having a surface. The assembly includes first and second interengageable parts. The first part is attached to one of the surface of the column and the member and includes a slot extending in a direction along the length of the surface of the column. The slot includes opposing outwardly inclined sides. The second part is attached to the other of the column and the member. The second part includes opposing sides correspondingly shaped with the slot sides and received within the slot to connect the end of the member and the column. The slot may be substantially "U" shaped.

In accordance with an additional embodiment, a connector is provided for connecting first and second hollow frame parts of a modular system. The connector includes first and second substantially perpendicular sections. Each of the sections is adapted to engage a different one of the frame parts, wherein the sections are received within different ones of the hollow frame parts, respectively.

In accordance with an additional embodiment, a panel assembly of a modular system is provided including a frame having first and second frame parts, a corner connector connecting the frame parts, and a fabric cover defining a recess with an open end adapted to receive the frame.

The frame may include a wall or header. The fabric cover may include stretch double interlock knit fabric. The frame may include extruded aluminum members. The panel assembly may include means for at least partially closing the open end of the fabric cover.

BRIEF DESCRIPTION OF THE SEVERAL VIEWS OF THE DRAWINGS

To these and to such other objects that may hereinafter appear, the present invention relates to a modular wall system for exhibitions as described in detail in the following specification and recited in the annexed claims, taken together with the accompanying drawings, in which like numerals refer to like parts in which:

Figure 1:
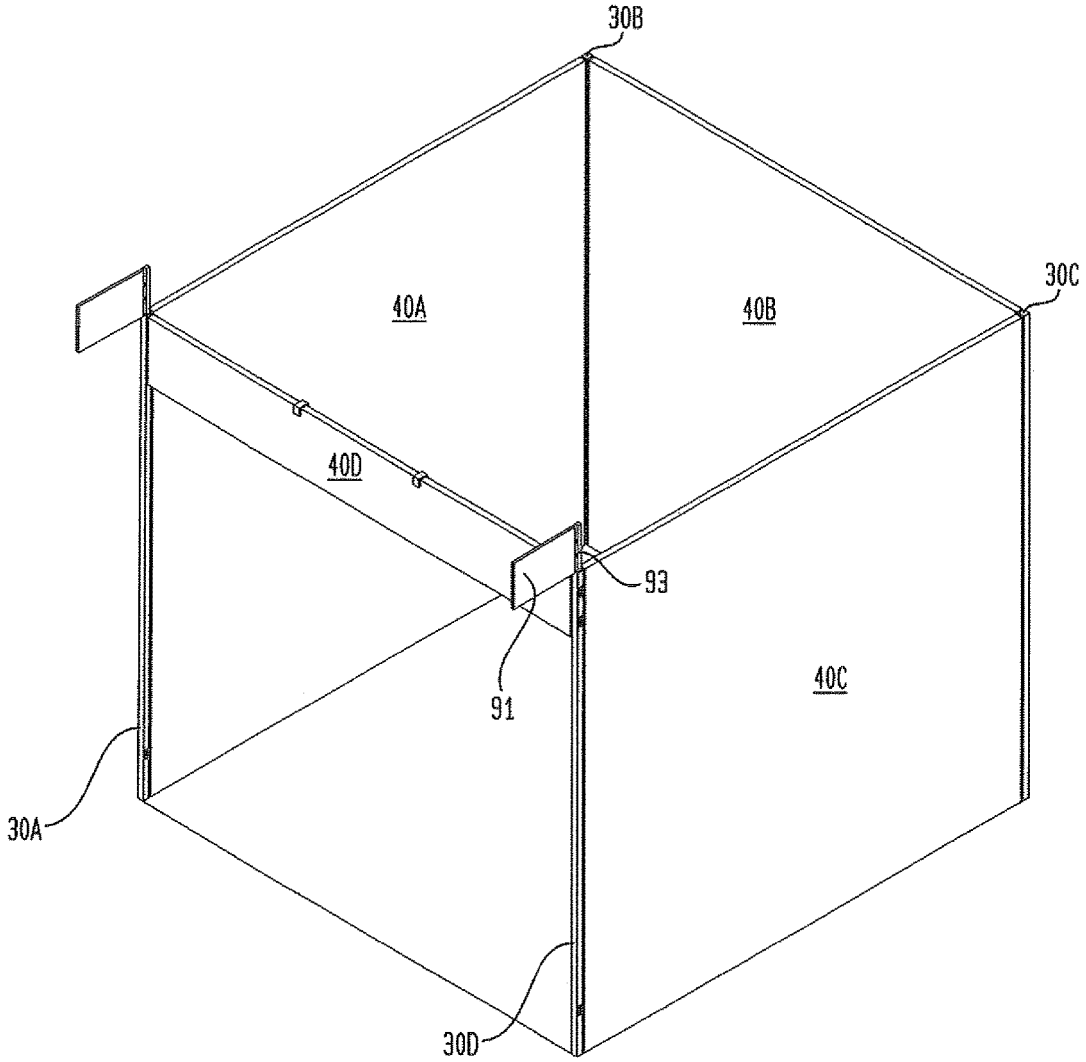
FIG. 1 is a perspective view of a basic single section embodiment of the modular wall system of the present invention including a header and wall panels extending between four upright columns.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

DETAILED DESCRIPTION OF THE INVENTION

The present invention is directed to a modular wall system 10 for use in exhibitions, trade shows and the like configured for maximum design flexibility, ease of assembly and disassembly, and simplicity in packing and shipping. In its broadest context, the system 10 includes at least one upstanding column 30, at least one member 40 having an end 32 and means 60 for detachably connecting the end of the member 40 to the column. Preferably, the member 40 takes the forms of a panel, which may comprise either a wall panel designed to extend over the entire height of a side of the booth, from the top of the booth to the bottom, or header panel, designed to extend over a part of a side of the booth, downwardly from the top.

FIG. 1 illustrates a basic single section embodiment of the modular wall system 10. In this embodiment, a substantially square booth design is provided having one open side for entry. The system 10 includes members 40 including three wall panels 40A, 40B, 40C and one header panel 40D. Each of the members 40 is connected at each end to one of the upstanding columns 30A, 30B, 30C, 30D. A connecting means, including a main bracket 60, detachably connects the end of each member 40 to a surface 32 of the upstanding column 30.

Figure 2:
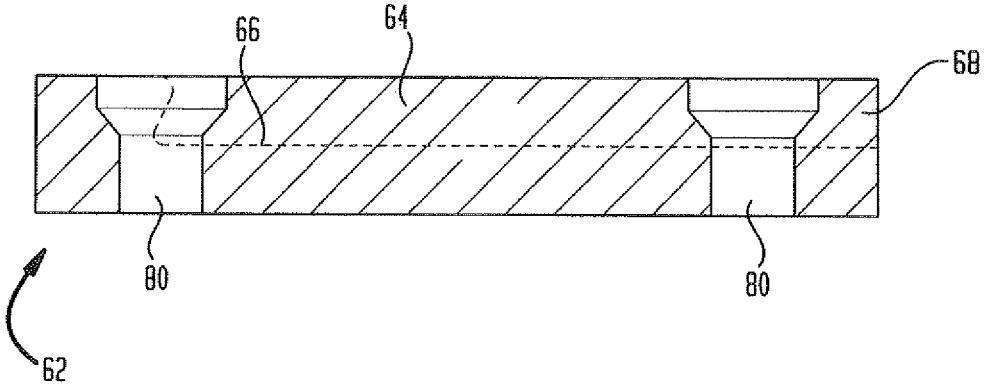
FIG. 2 is a cross-sectional view of the female part of the main bracket of the connecting means of the system taken along line 2-2 of FIG. 3.
Figure 3:
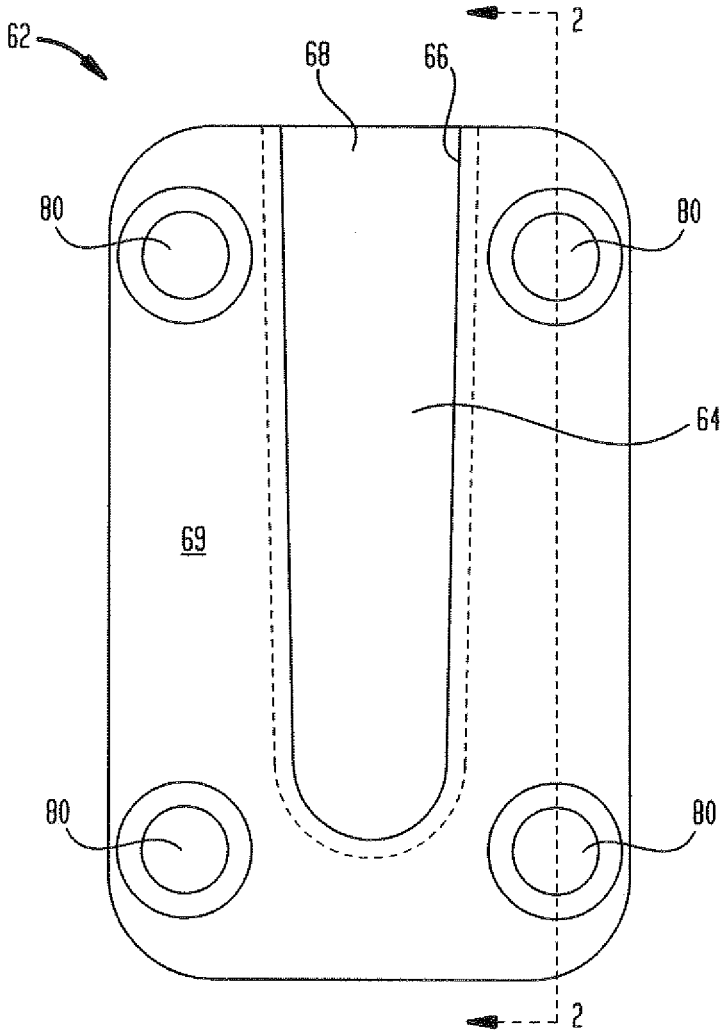
FIG. 3 is a front plan view of the female part of the main bracket.
Figure 5:
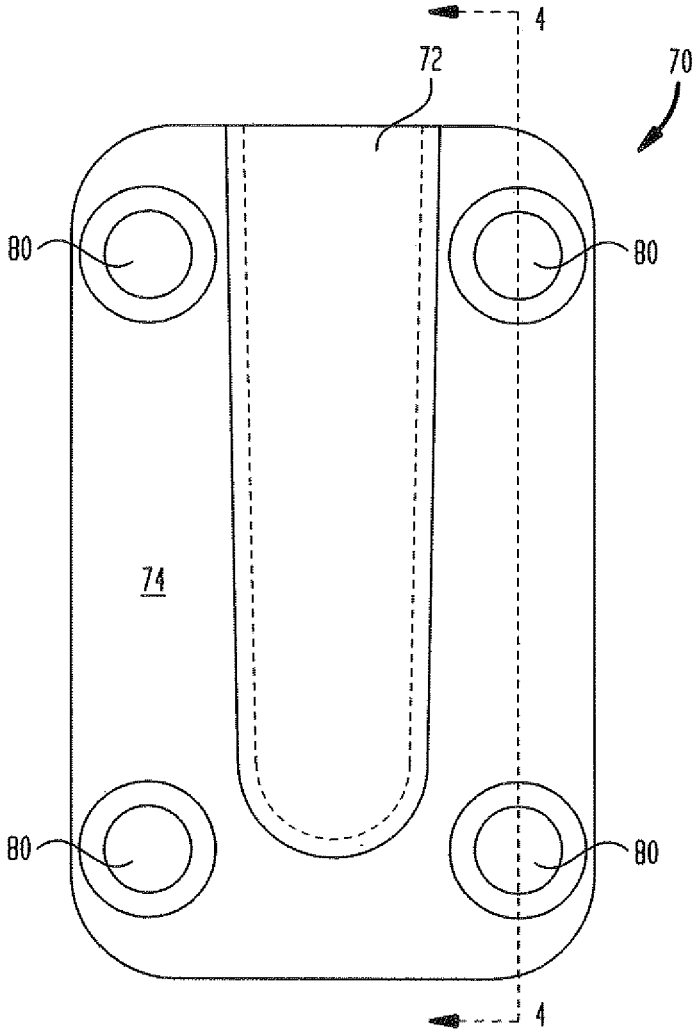
FIG. 5 is a front plan view of the male part of the main bracket.
Figure 6:
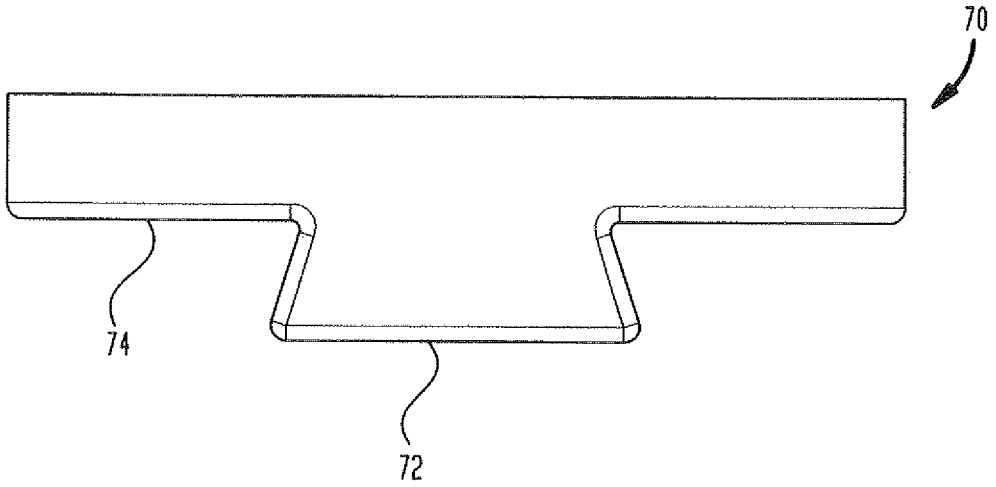
FIG. 6 is an exploded end view of the male part of the main bracket of FIG. 5.
Figure 7:
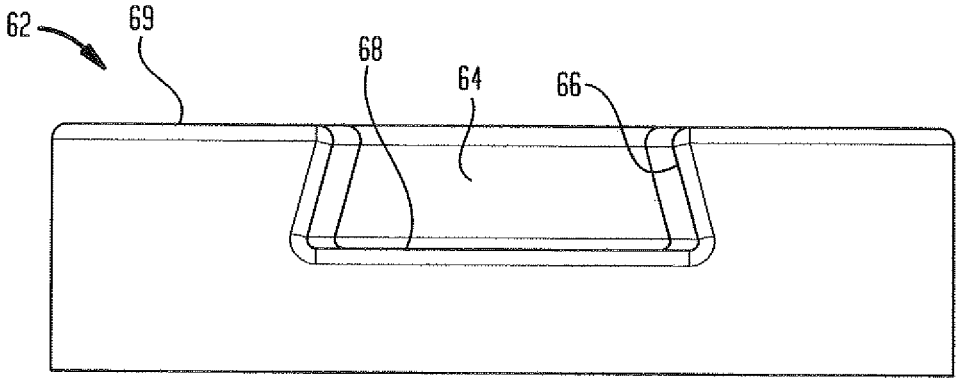
FIG. 7 is an exploded end view of the female part of the main bracket of FIG. 3.

FIGS. 2-8 illustrate the main bracket 60 of the connecting means of the system, which includes first and second interchangeable parts 62, 70. Preferably, the first part 62 is coupled to each end of the panel member, while the second part 70 is coupled to the surface of each column 30 to which the panel member is to be attached. FIGS. 2, 3 and 7 illustrate the first interchangeable part 62, which is preferably a female connection part having an open-faced slot 64 extending in a direction along the length of the surface 32 of the column. The open-faced slot defines a channel 66 extending in a plane substantially parallel to the surface 32 of the column 30. Preferably, the open-faced slot 64 is substantially U-shaped. The open-faced slot 64 is defined by a side surface 69, which has an open top and a closed bottom. Channel 66 is situated in the side surface 69.

Figure 4:
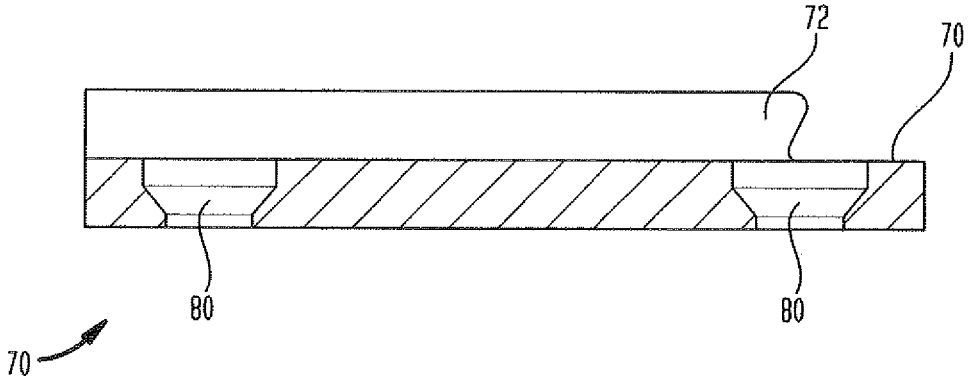
FIG. 4 is a cross-sectional view of the male part of the main bracket of the connecting means of the system taken along line 4-4 of FIG. 5.
Figure 8:
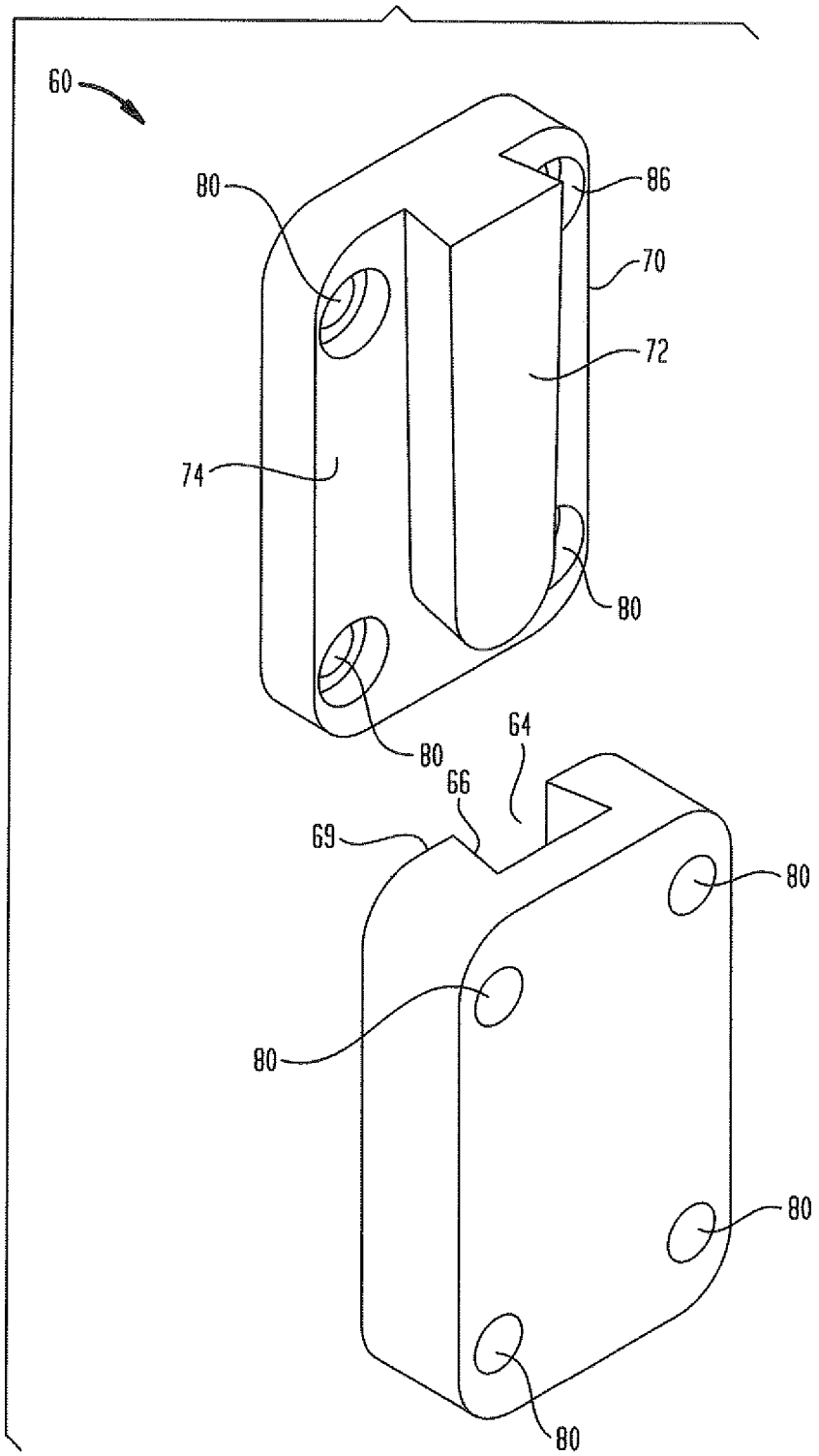
FIG. 8 is an exploded perspective view of the male and female parts of the main bracket of the connecting means.

FIGS. 4, 5 and 6 illustrate the second interchangeable part 70 of the main bracket 60, which is preferably a male connection part having an outwardly extending flange 72. The male part 70 has a shape corresponding to that of slot 64 and includes a side surface 74. Flange 72 extends outwardly from the side surface 74. As shown in FIG. 8, the male part 70 is received within the open-faced slot 64 of the female part 62, such that the outwardly extending flange 72 of the male part 70 is received within the channel 66 of the female part 62.

Each of the female and male parts 62, 70 is mounted on a base 71 which has at least one opening 80 extending substantially therethrough for securing the part to the panel or column by a rivet or other like fastening means. Preferably, four openings 80 are provided on the base 71 of each of the parts 62, 70 to ensure a strong connection between the part and the column or panel to which it is attached.

Figure 9:
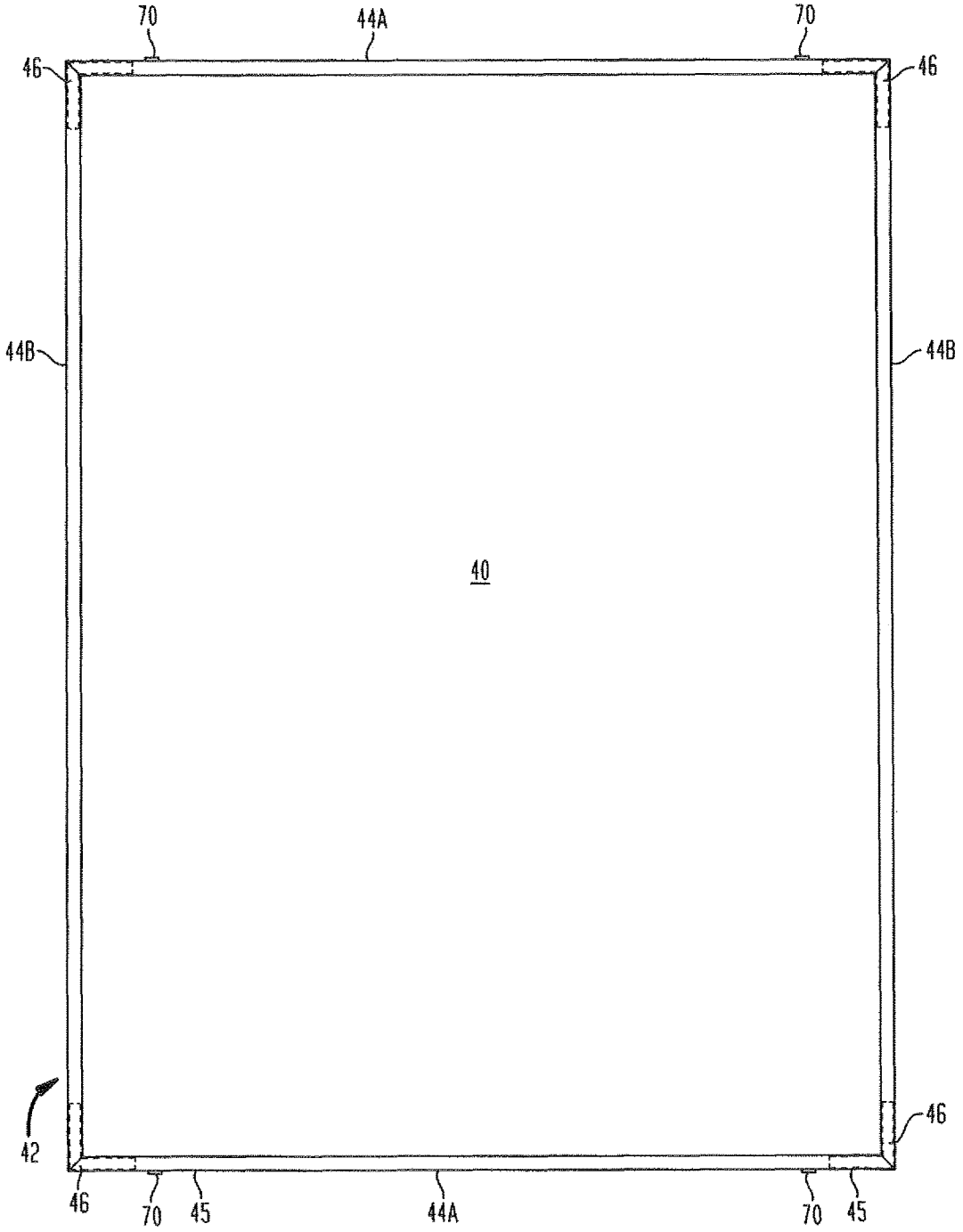
FIG. 9 is a front elevation view of a panel of the modular wall system showing the frame and corner connectors.
Figure 10A:
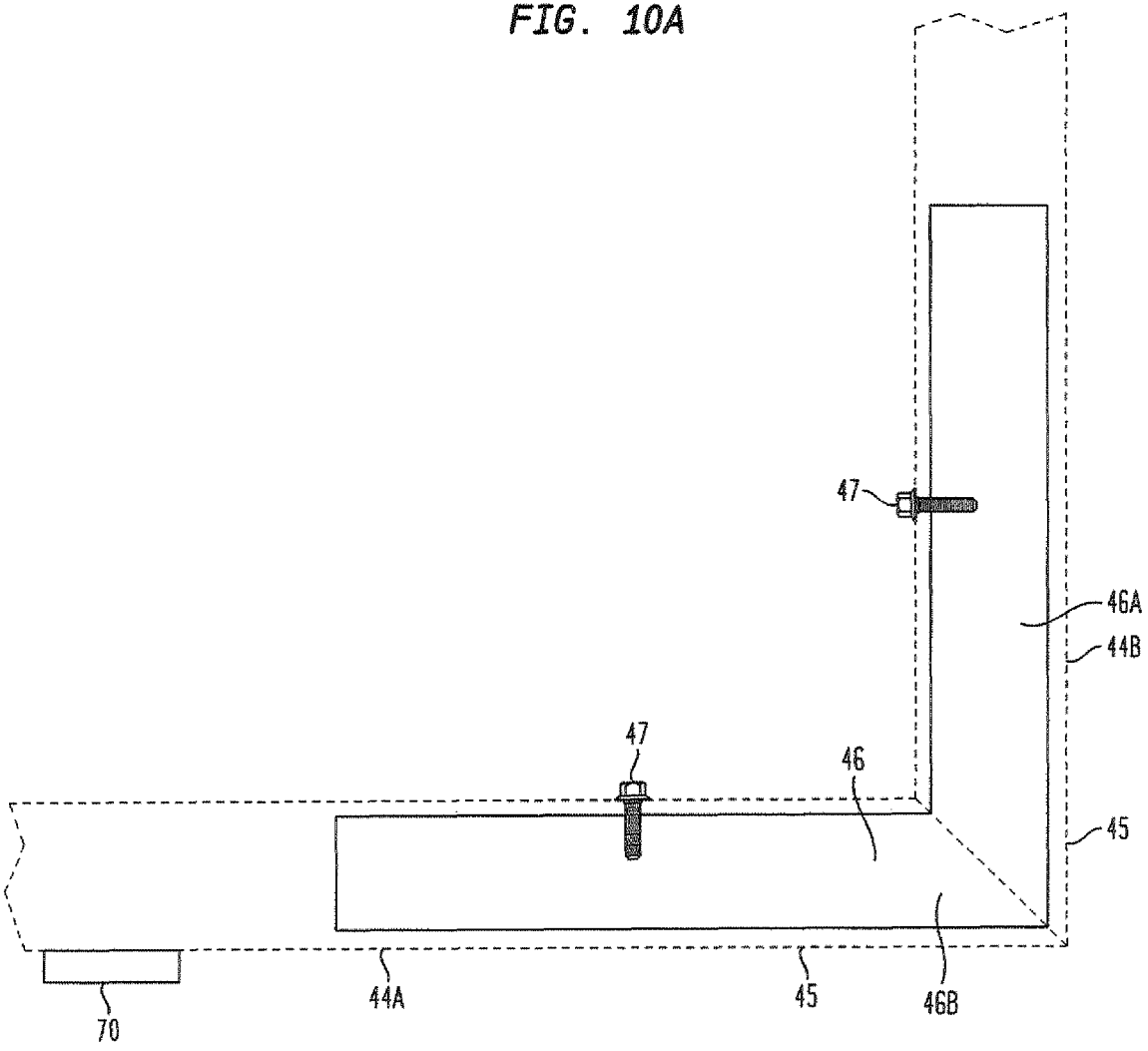
FIG. 10A is an enlarged front elevation view of a corner of a wall panel of FIG. 9 showing the frame components and the corner connector.
Figure 10B:
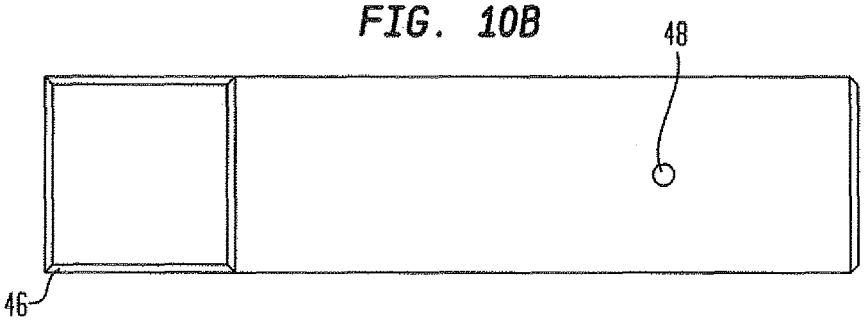
FIG. 10B is a top elevation view of the corner connector of FIG. 10A.
Figure 10C:
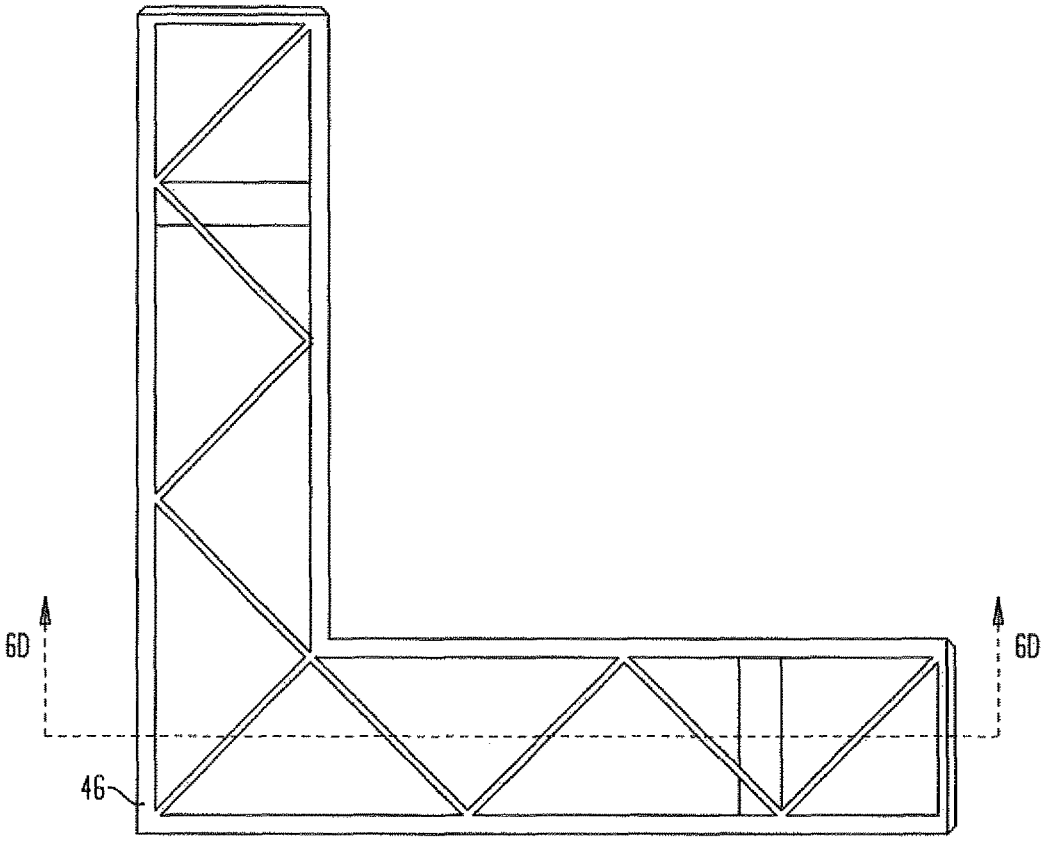
FIG. 10C is a side elevation view of the corner connector of FIG. 10A.
Figure 10D:
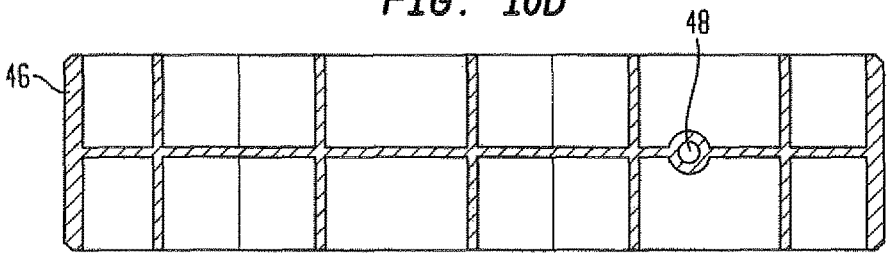
FIG. 10D is a bottom elevation view of the corner connector of FIG. 10A.

Referring to FIG. 9, the member 40 takes the form of a panel 40, which includes a frame 42. Frame 42 is formed of connected hollow frame parts 44, each having an end 45. Preferably, the hollow frame parts 44 are made of extruded aluminum.

The ends of each pair of adjacent frame parts, such as frame parts 44A, 44B, are connected together by a corner connector 46. Preferably, each corner connector 46 is formed of substantially perpendicular sections 46A, 46B. Sections 46A and 46B are adapted to be received within the ends 45 respectively of the hollow frame parts 44 for connecting the frame parts together. Preferably, four parts 44, including two parallel spaced first parts 44A and two parallel spaced second parts 44B, are connected together by four corner connectors 46 to form a substantially rectangular frame 42.

FIGS. 10A-10D illustrate the corner connector 46, which is preferably made from injection molded plastic. The first and second substantially perpendicular sections 46A, 46B are each adapted to be received within a different end 45 of one of the hollow frame parts 44 and to be securely held in place by at least one set screw, rivet 47 or other conventional fastener. Each corner connector 46 includes at least one, and preferably two, substantially circular guide holes 48 extending therethrough for accepting the rivet 47.

The base 71 of the female part 62 of each main bracket 60 is coupled to the end portion of each opposing hollow frame part of the panel 40. More specifically, the female part 62 extends outwardly from the frame part 44 at a location approximately nine inches from the end 45 of the frame part.

Panels 40 may take the form of either wall panels 40A, 40B, 40C or header panels 40D depending on the design specifications of the system. When closed sides are required, wall panels are utilized. When opened sides are desired, header panels are utilized. The height of the second frame parts 44B of the frame 42 differs depending on whether a header 40D or a wall panel 40A is being provided.

Figure 11:
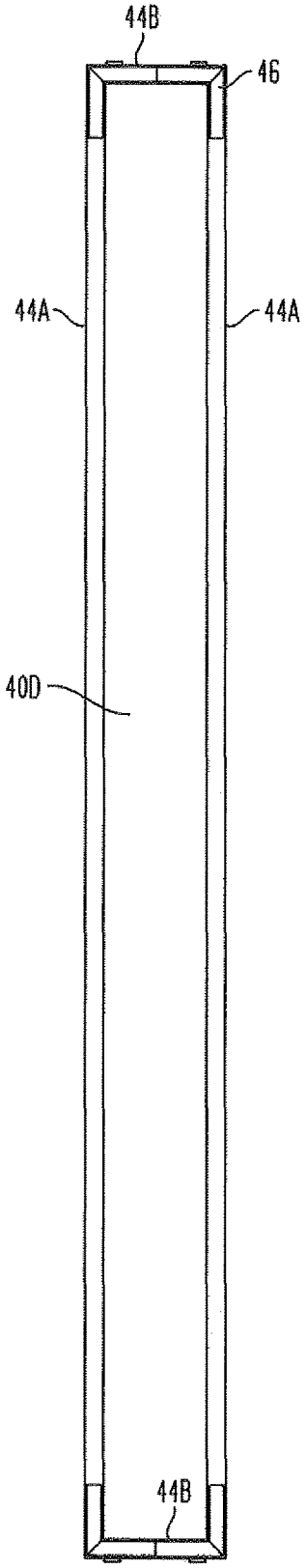
FIG. 11 is a front elevation view of a header of the modular wall system showing the frame and female parts of the main bracket.

FIG. 11 illustrates the header 40D. Header 40D provides added stability and support to the structure of the system 10, while at the same time creates an opening for allowing access to the booth. In addition, header 40D may be used for displaying signage, advertising messages or special verbiage.

Figure 12:
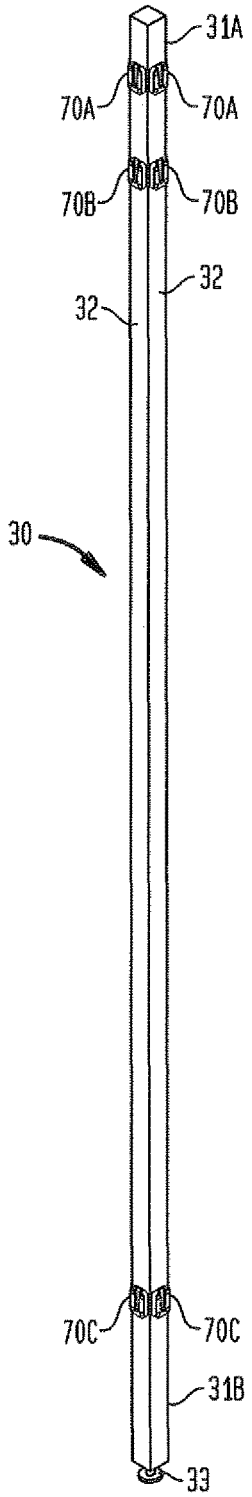
FIG. 12 is a perspective view of an upstanding column of the modular wall system.
Figure 22:
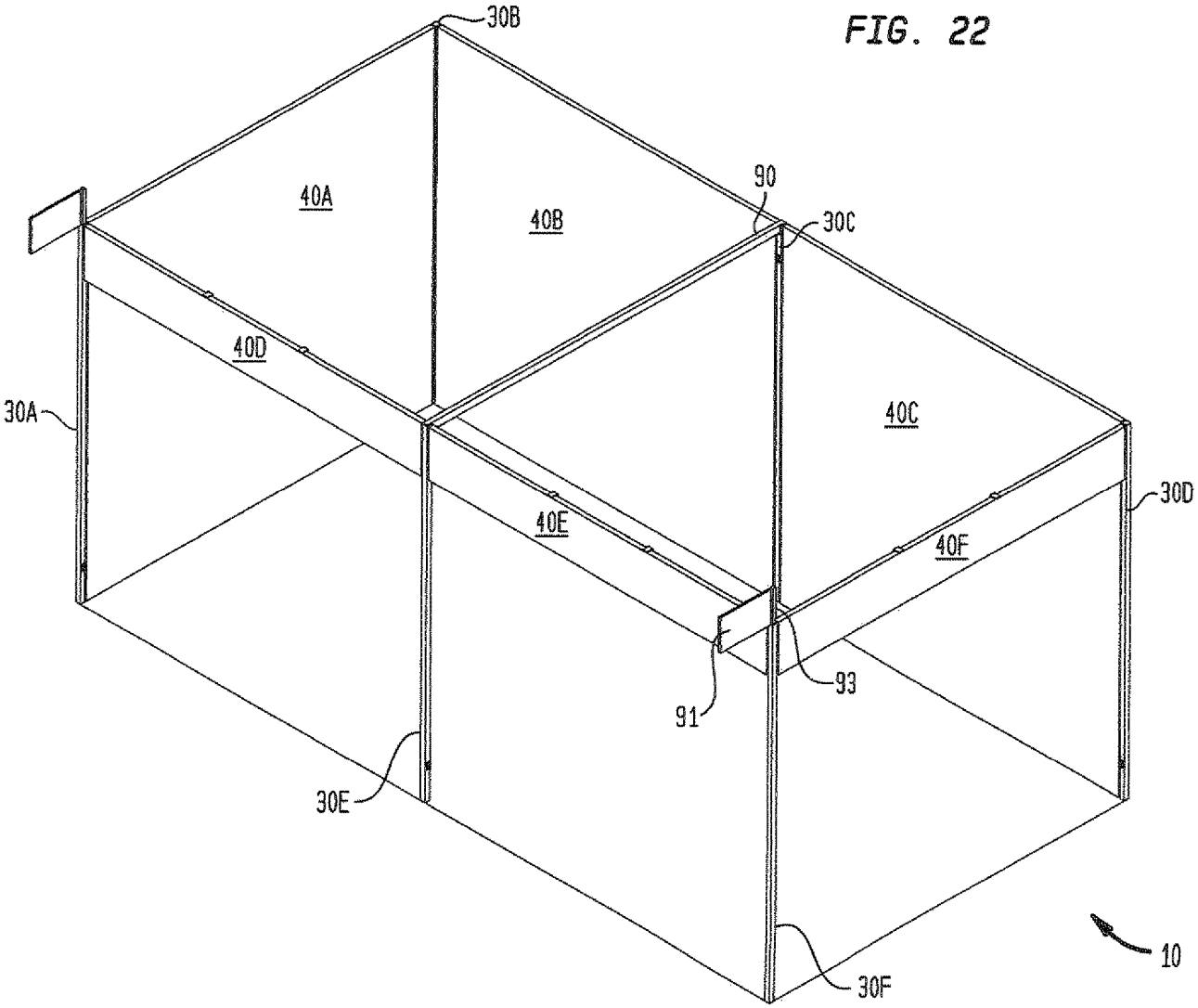
FIG. 22 is a perspective view of an open sided, two-section wall embodiment of the modular wall system of the present invention.

FIG. 12 illustrates an upstanding column 30 of the modular system. During construction of the booth, column 30 is detachably connected to one, two, three or four panels 40. Column 30 is configured to be universally adaptable within the system for connecting with wall panels 40A, header panels 40D, or accessories without modification. A support 90, shown in FIG. 22, is adapted to extend between the columns, specifically from one column 30C to a second column 30E in order to provide additional support and stability to the system 10. Column 30 is also adaptable for connecting with support 90.

Column 30 is a substantially elongated hollow aluminum member having a top end 31A and a bottom end 31B and at least one side surface 32. The bottom end 31B preferably includes an adjustable foot 33 for altering the height of the column in order to accommodate unevenly spaced flooring.

Figure 13:
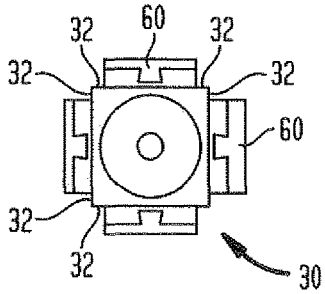
FIG. 13 is an end view of the upstanding column of FIG. 10 showing four outwardly extending male connecting parts.

In the preferred embodiment, shown in FIG. 13, the cross-sectional shape of the column 30 is substantially square, being defined by four side surfaces 32. Each of the four side surfaces 32 includes three outwardly extending male parts 70 spaced along the surface. The first male parts 70A extend outwardly from each side surface 32 of the column proximate the top end 31A. More specifically, the first male parts 70A are approximately ¾ inch from the top end of the column. The second male parts 70B extend outwardly from each side surface 32 of the column proximate the top end 31A and a short distance below the first male parts 70A. More specifically, the second male parts 70B are approximately nine inches from the top end 31A of the column. The third male parts 70C extend outwardly from each side surface 32 of the column proximate the bottom end 31B. More specifically, the third male parts 70C are located approximately eleven inches from the bottom end of the column.

The female parts 62 are preferably coupled to the ends 45 of each panel 40, and adapted to engage selected ones of the male parts 70 extending from the surfaces 32 of columns 30. As such, the outwardly extending flange 72 of the male part 70 is adapted to be received within the channel 66 of the female part 62. Thus, the female parts 62 of the panels 40 interengageably connect with the male parts 70 of the columns 30.

Figure 14:
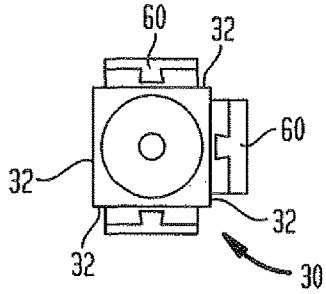
FIG. 14 is an end view of an alternate embodiment of the upstanding column, showing three outwardly extending male connecting parts.
Figure 15:
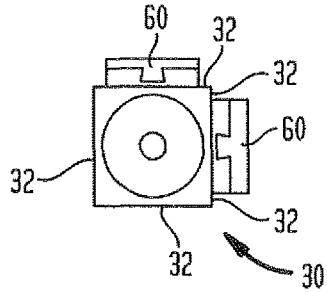
FIG. 15 is an end view of an alternate embodiment of the upstanding column, showing two outwardly extending male connecting parts.

FIGS. 14 and 15 illustrate alternate embodiments of the upstanding column 30 of the system, where outwardly extending male parts 70 are provided along three sides of the column (shown in FIG. 14) or are provided along two sides of the column (shown in FIG. 15).

In alternate embodiments, the locations of the female parts and of the male parts may be reversed such that the female parts 62 are coupled to columns 30 and the male parts 70 are fixed to the panel frames. However, in order to provide universal integration of the columns, panels and headers within the system, it is necessary for all columns to contain either male or female parts exclusively, while members of the frame of the panels and headers contain oppositely engaging parts.

It should be understood that providing columns 30 with a substantially square cross-section enables the walls and headers to be positioned in perpendicular configuration to one another, allowing square and rectangular booths to be configured.

Figure 16:
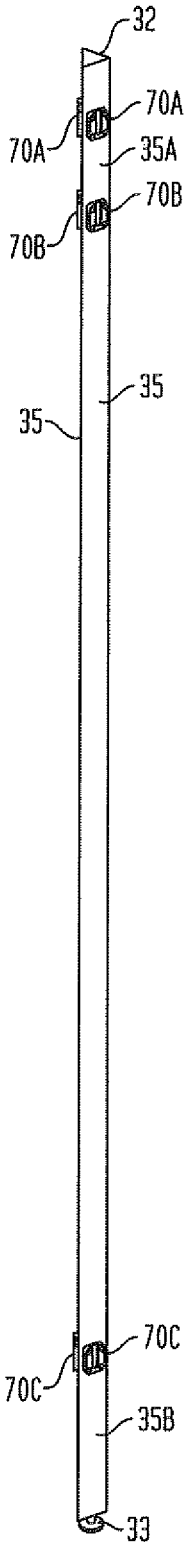
FIG. 16 is a perspective view of an alternate embodiment of an upstanding column of the modular wall system.
Figure 17:
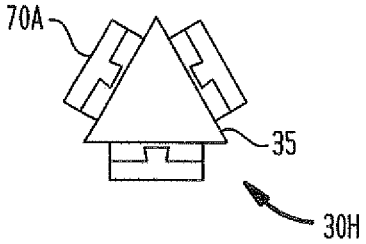
FIG. 17 is an end view of the upstanding triangular column of FIG. 16 showing three outwardly extending male connecting parts.

FIGS. 16 and 17 illustrate alternate embodiment of the upstanding column 30H of the present system, where the column 30H includes a substantially triangular cross-section. The bottom end 35B of the upstanding triangular column 30H includes an adjustable foot 33 for altering the height of the column for accommodating unevenly spaced flooring.

In this alternate embodiment, the triangular cross-section of the column 30H defines three side surfaces 35. Each of the three side surfaces 35 includes three outwardly extending male parts 70. The first male parts 70A extend outwardly from each side surface 35 of the column proximate the top end 35A. More specifically, the first male parts 70A are approximately ¾ inch from the top end of the column. The second male parts 70B extend outwardly from each side surface 35 of the column proximate the top end 35A and a short distance below the first male parts 70A. More specifically, the second male parts 70B are approximately nine inches from the top end of the column. The third male parts 70C extend outwardly from each side surface 35 of the column proximate the bottom end 35B. More specifically, the third male parts 70C are approximately eleven inches from the bottom end of the column.

Figure 18:
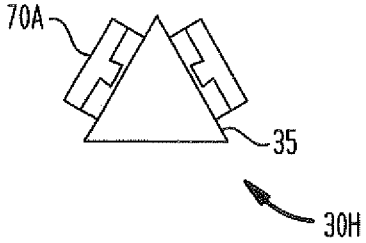
FIG. 18 is an end view of an alternate embodiment of the upstanding triangular column, showing two outwardly extending male connecting parts.
Figure 19:
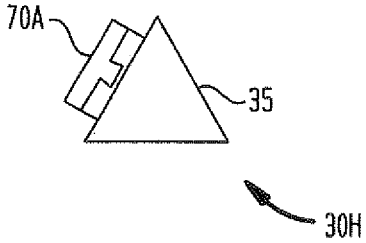
FIG. 19 is an end view of an alternate embodiment of the upstanding triangular column, showing one outwardly extending male connecting part.

FIGS. 18 and 19 illustrate alternate embodiments of the upstanding triangular column 30H of the system, where outwardly extending male parts 70 are provided along two side surfaces of the column (shown in FIG. 18) or provided along one side surface of the column (shown in FIG. 19).

It should be understood that providing the column 30H with a substantially triangular cross-section enables the walls and headers to be positioned in non-perpendicular configuration to one another, allowing alternate shaped booths to be configured. Alternative columns are contemplated herein having cross-sectional configurations, including but not limited to, circular, square, rectangular, hexagonal, octagonal, and oval.

Figure 20:
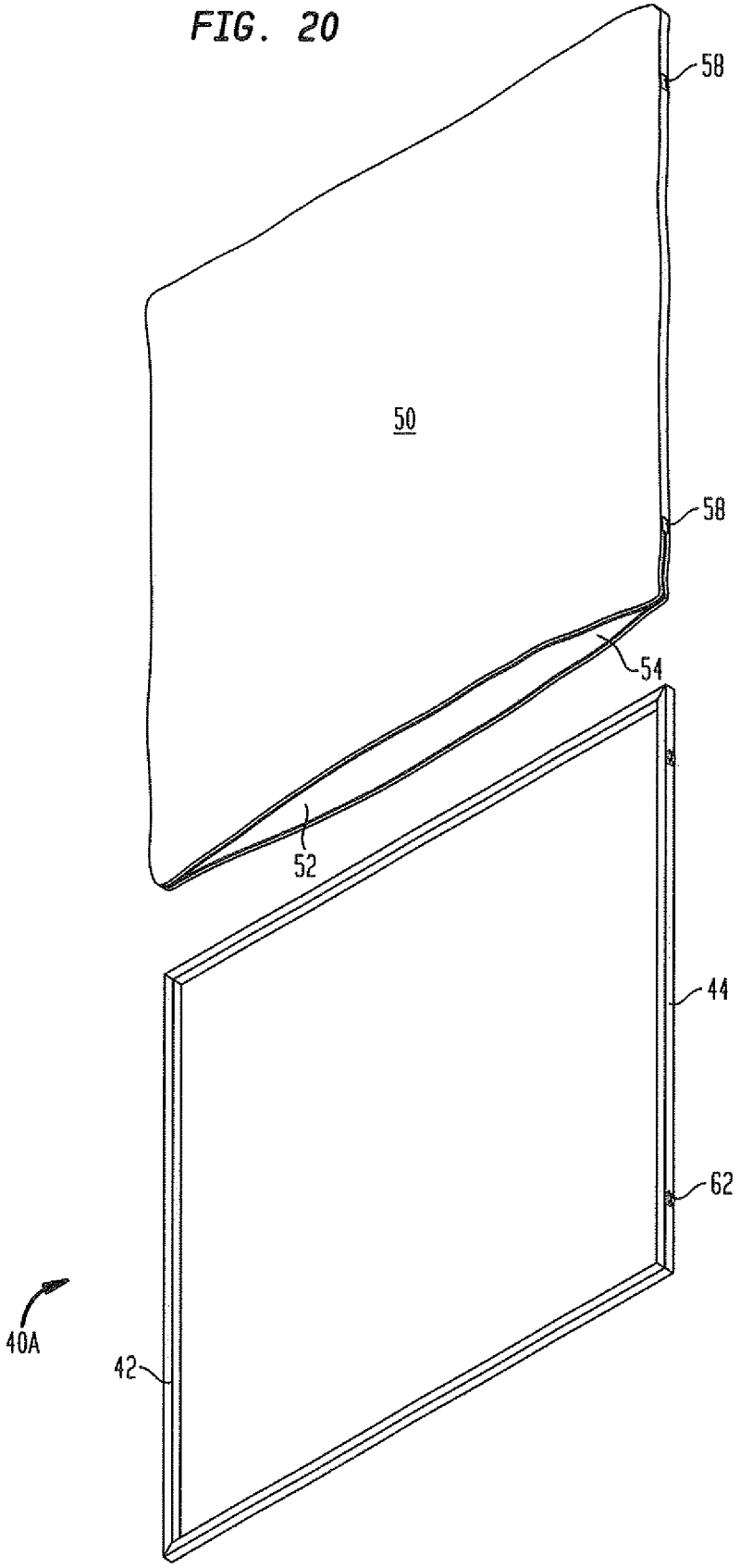
FIG. 20 is an exploded perspective view of a wall panel of the modular wall system showing the frame and removable fabric covering.

FIG. 20 illustrates the panel 40 of the modular wall system, which includes the frame 42 and fabric covering 50. The fabric covering 50 includes a recess 52 having an open end 54 adapted to receive the frame 42. Preferably, a zipper 56 extends along the open end 54 to enclose the frame 42 within the fabric covering 50. Hook and loop sections may also extend along the open end 54 to enclose the frame 42 within the fabric covering 50. The fabric covering 50 also includes a plurality of openings 58, which are adapted for receiving the female parts 62 secured to the panel 40 therethrough. The fabric covering 50 is available in a variety of different colors or patterned designs, preferably fire retardant, resistant to stains and printable. The fabric covering may be, but is not limited to, tricot interlock polyester or other stretch double interlock knit fabric.

Figure 21:
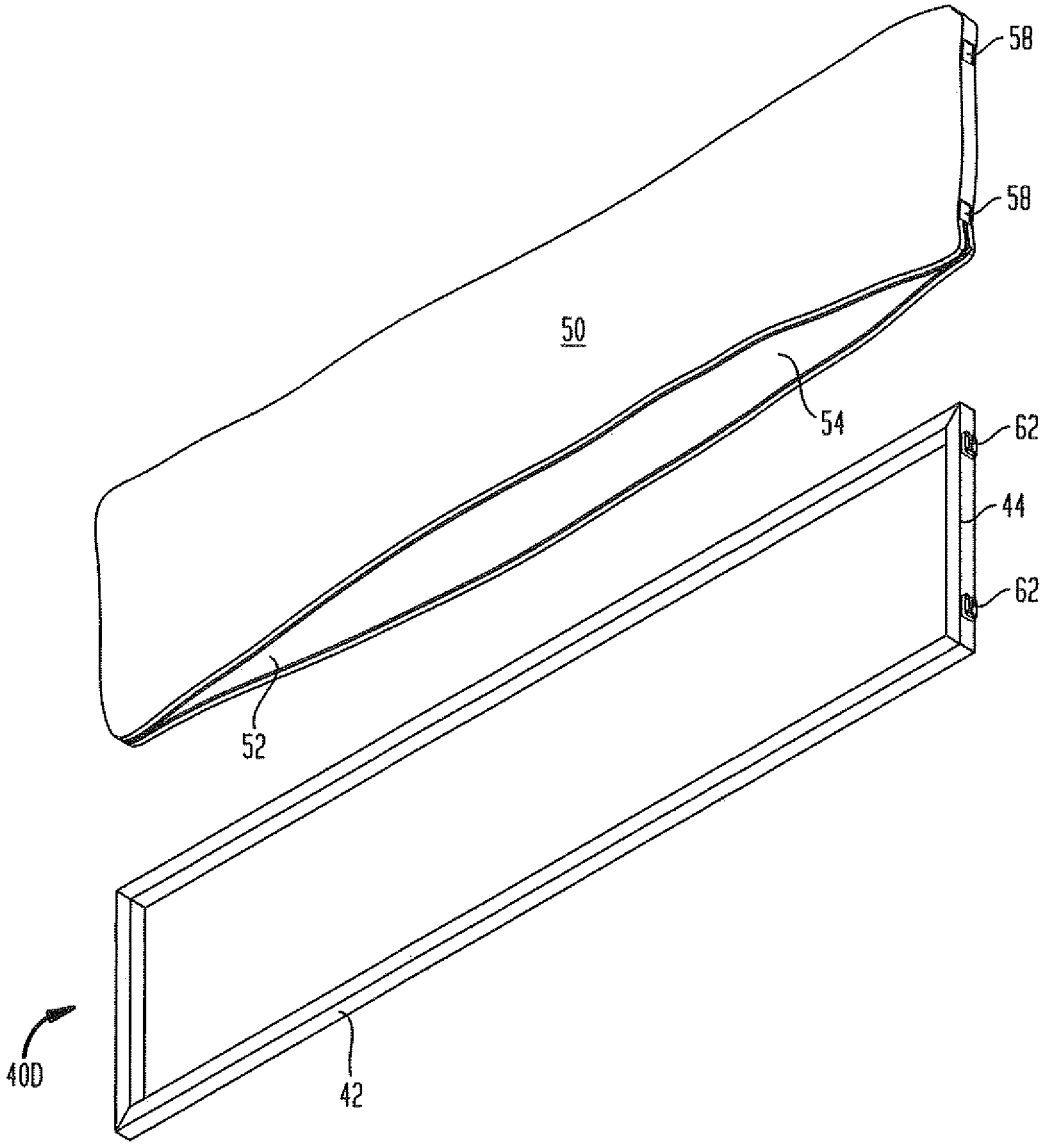
FIG. 21 is an exploded perspective view of the header panel of the modular wall system showing the frame and removable fabric covering.

FIG. 21 illustrates the header panel 40D of the modular wall system, which includes the frame 42 and fabric covering 50. The fabric covering 50 includes the recess 52 having the open end 54 adapted to receive the frame 42. Preferably, the zipper 56 extends along the open end 54 to enclose the frame 42 within the fabric covering 50. The fabric covering 50 also includes a plurality of openings 58 that are adapted for receiving the female parts 62 secured to the panel 40 therethrough. The fabric covering 50 is available in a variety of different colors or patterned designs, preferably fire retardant, resistant to stains and printable. The fabric covering may be, but is not limited to, tricot interlock polyester or other stretch double interlock knit fabric.

In the embodiment illustrated in FIG. 1, a substantially square booth design is provided having one open side for entry. The system 10 includes three wall panels 40A, 40B, 40C and one header panel 40D, secured at each end by the upstanding columns 30A, 30B, 30C, 30D. The main bracket 60 of the connecting means detachably connects the ends of each panel 40 to the surface 32 of the upstanding column 30.

FIG. 22 illustrates a two-section embodiment of the modular wall system defining a substantially rectangular booth with an open side. The system 10 includes three wall panels 40A, 40B, 40C and three headers 40D, 40E, 40F, secured at each end by the upstanding columns 30A, 30B, 30C, 30D, 30E, 30F. The columns 30 are detachably connected at each end 32 of the header 40D and wall panels 40A, 40B, 40C by the main bracket 60 of the connecting means. Support 90 is adapted to extend between the columns, specifically from one column 30C to a second column 30E in order to provide additional support and stability to the system 10. A sign 91 is provided for displaying the name of the booth thereon and includes an elongated support 93 for insertion into the top end 31A of the hollow column 30D.

Figure 23:
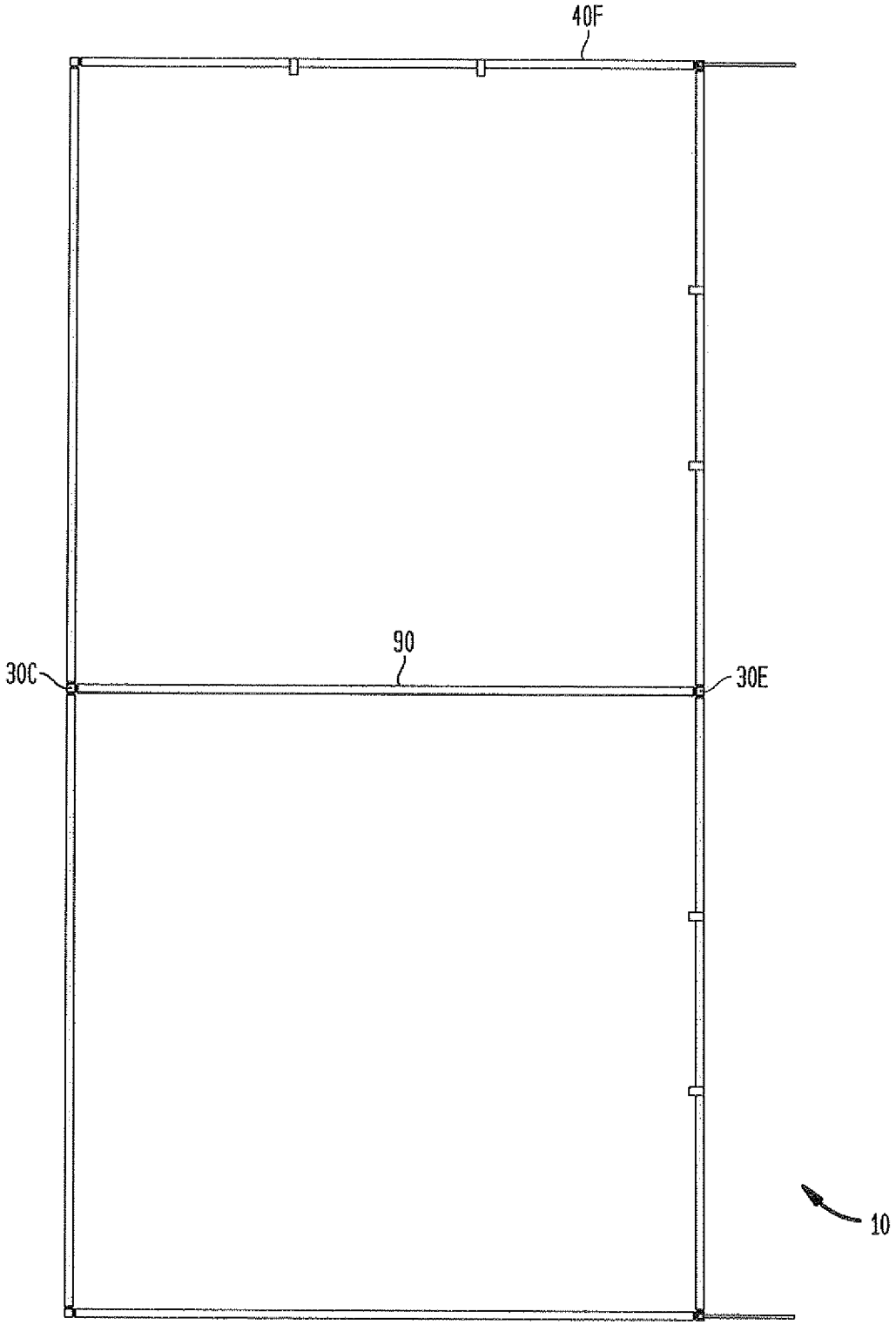
FIG. 23 is a top elevation view of the two-section embodiment of the modular wall system of FIG. 22.
Figure 24:
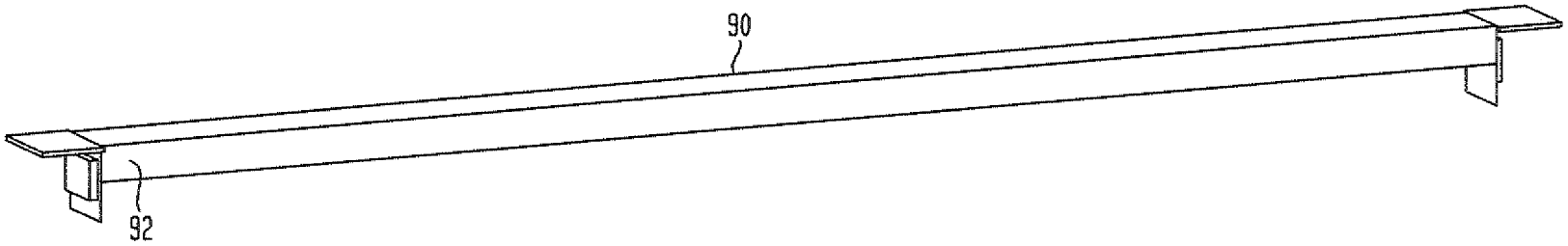
FIG. 24 is a perspective view of a support within the two-section embodiment of the modular wall system illustrated in FIG. 22.
Figure 25:
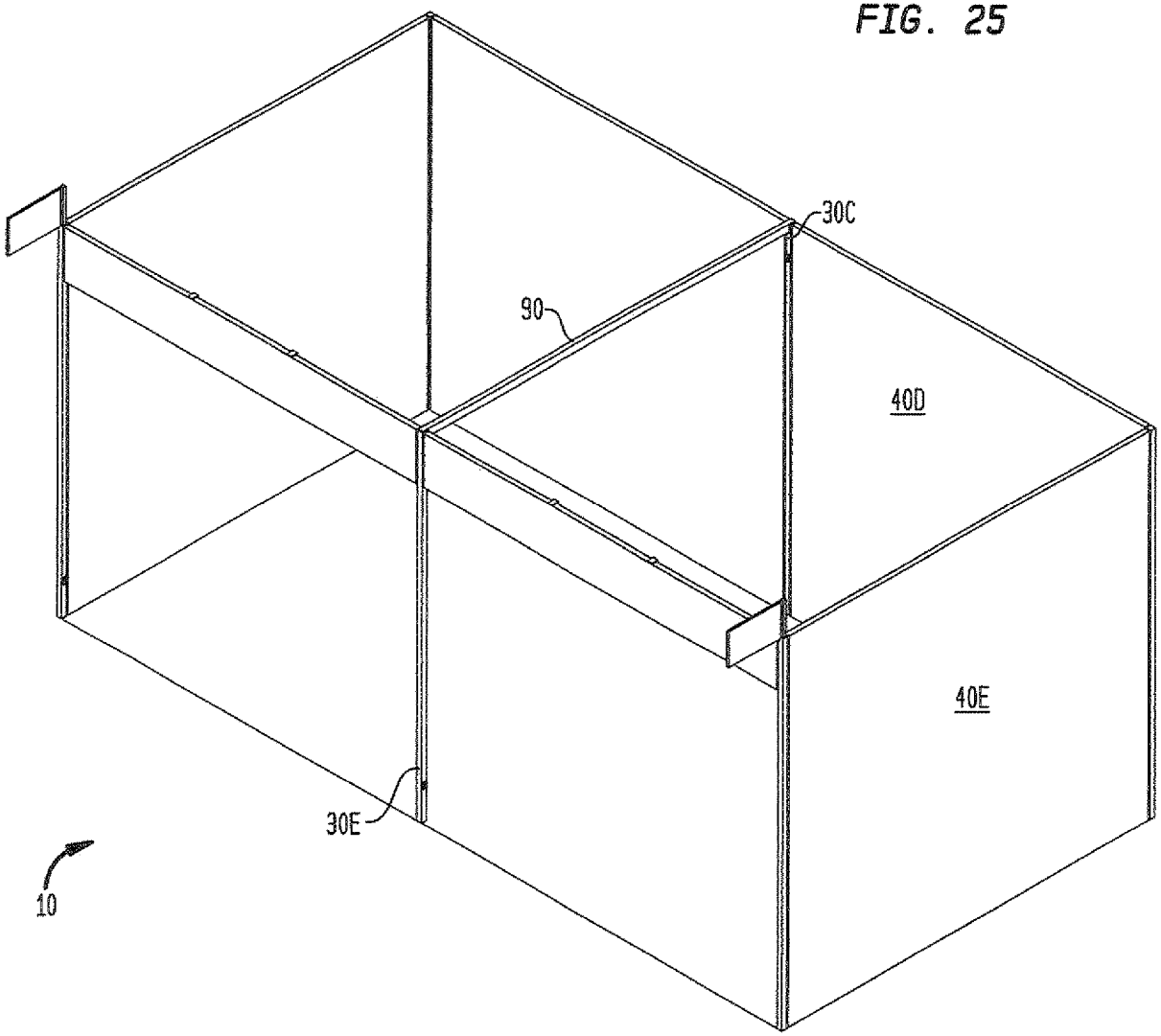
FIG. 25 is a perspective view of a closed sided, two section embodiment of the modular wall system of the present invention.
Figure 26:
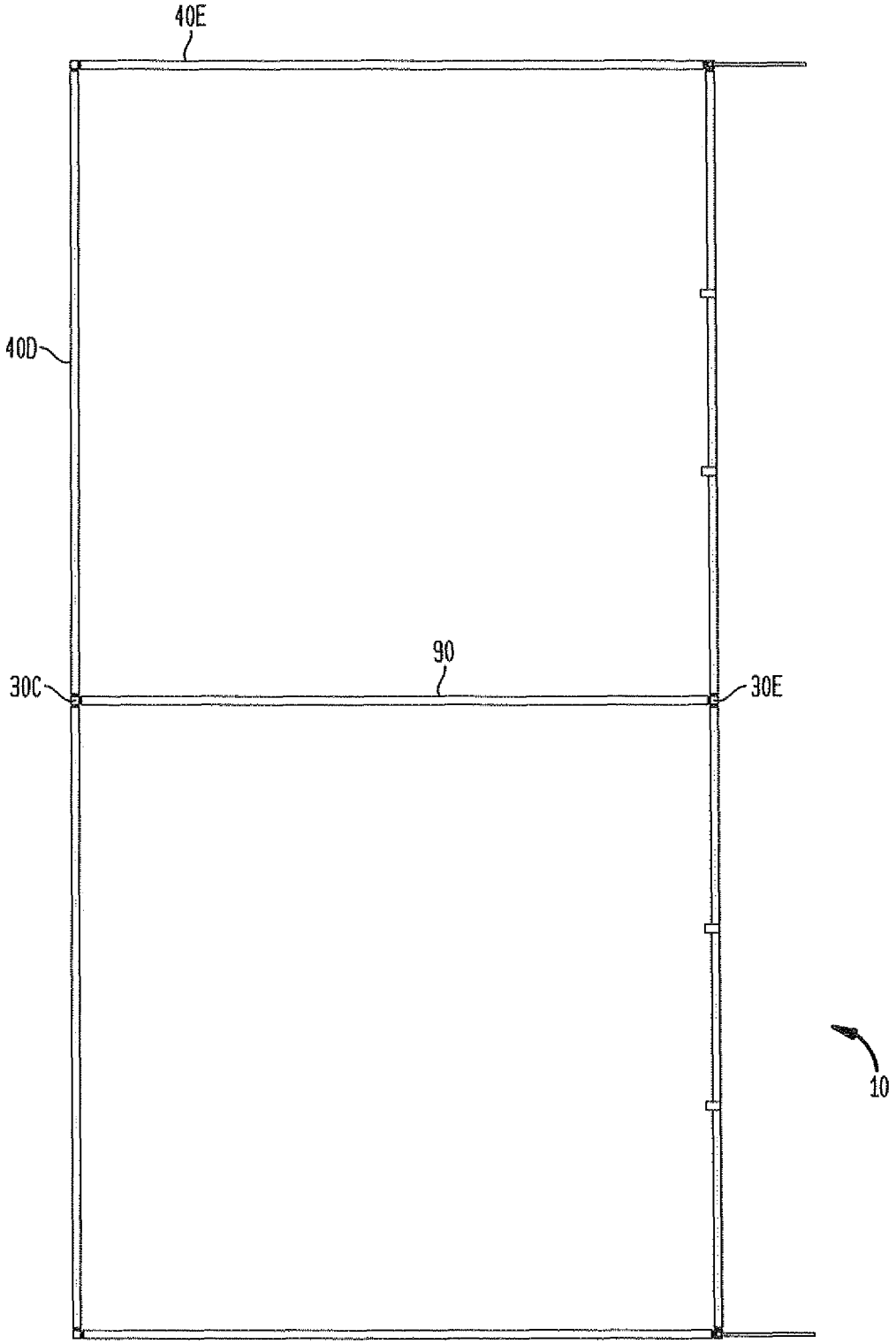
FIG. 26 is a top elevation view of the modular wall system of FIG. 25.

The support 90, illustrated in FIG. 24, is composed of extruded aluminum and is hollow. The support 90 includes two ends 92 and extends between columns 30C, 30E as illustrated in FIGS. 22-23.

Figure 27A:
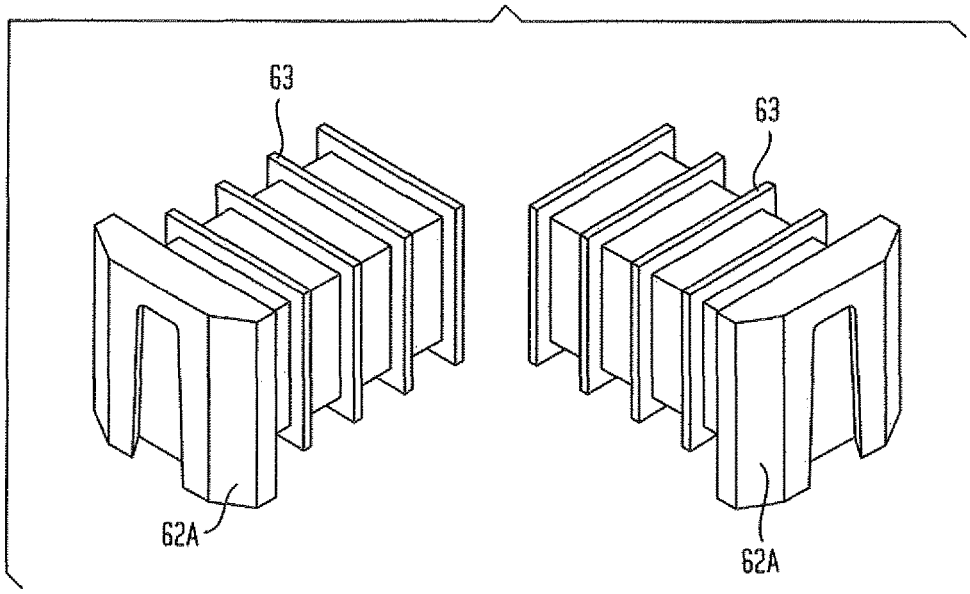
FIG. 27A is a perspective view of two female connecting brackets of the type used for joining the ends of a support of the type shown in FIG. 24 to the columns.
Figure 27B:
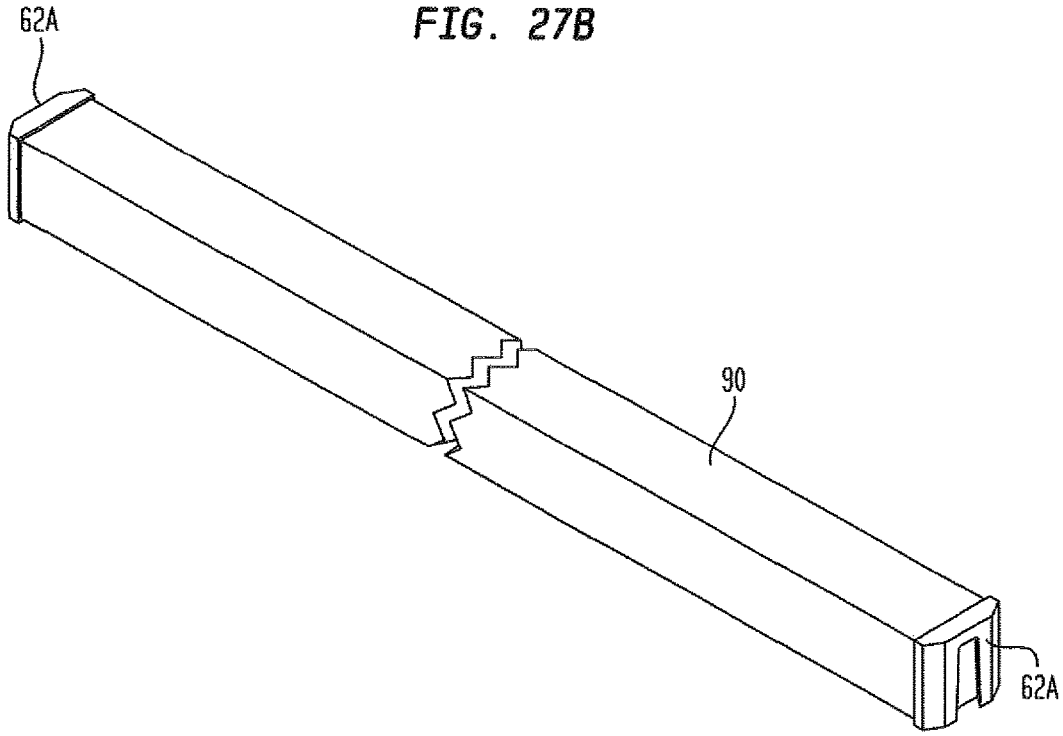
FIG. 27B is a perspective view of a support of the type shown in FIG. 24 showing the female connecting brackets received within ends thereof.

FIGS. 27A, 27B illustrate a means for detachably connecting the ends of the support to the surfaces of the columns 30. The support connecting means includes use of female connecting brackets 62A for joining the ends of the support 90 to the surfaces of columns 30. The female connecting bracket 62A is substantially similar in design to the female part 62, including an open-faced slot 64A extending in a direction along the length of the surface 32 of the column. The open-faced slot 64A defines a channel 66A extending in a plane substantially parallel to the surface 32 of the column 30. Preferably, the open-faced slot 64A is substantially U-shaped. The open slot-faced slot 64A is defined by a side surface 69A, such that the channel 66A is situated in the side surface 69A. The female connecting bracket 62A further includes an elongated ribbed securing member 63 extending outwardly therefrom.

The securing member 63 of the female connecting bracket 62A is received within the ends 92 of the support 90, for joining the support 90 to the column 30. More specifically, as discussed supra, the male parts 70 are coupled to the side surfaces 32 of the column 30, such that the outwardly extending flange 72 of the male part 70 is adapted to be received within the channel 66A of the female connecting part 62A. Thus, the female connecting bracket 62A within the ends of the support 90 interengageable connects with the male parts 70 of the columns 30.

In a modular wall system having a generally square or rectangular configuration, as illustrated in FIGS. 22, 25, 26 and 27A, 27B, the elongated ribbed securing member 63 extends outwardly from the female connecting bracket 62A in a generally perpendicular direction.

In FIGS. 27A and 27B, the ribbed securing members 63 are adaptable for insertion into the ends 92 of a support 90 which extends generally perpendicularly between two columns 30C, 30D. A rivet 102, set screw or other conventional fastener may be used for more permanently securing the female connecting bracket 62A into the hollow end 92 of the support 90.

Figure 28A:
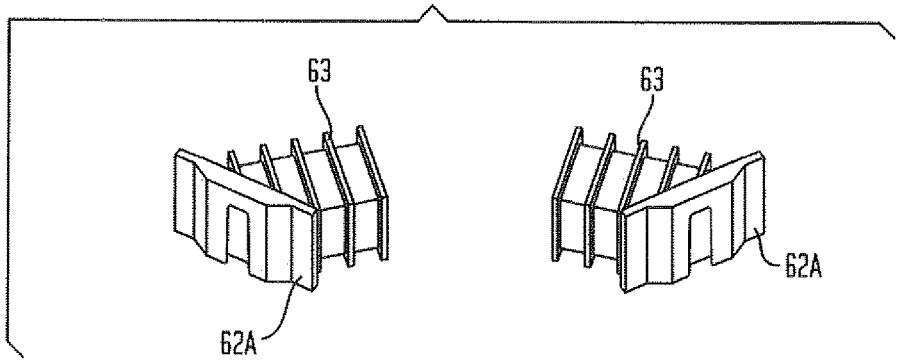
FIG. 28A is a perspective view of two female connecting brackets of the type used for joining the mitered ends of a support to the columns.
Figure 28B:
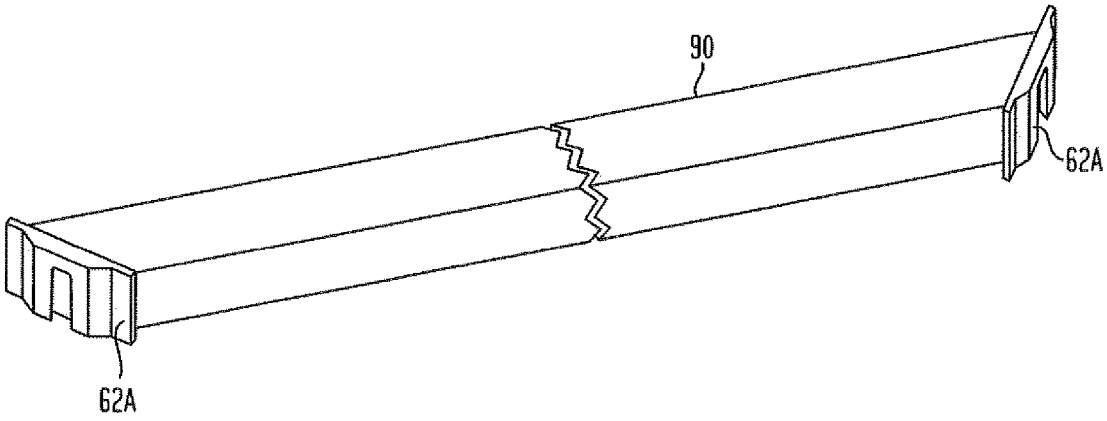
FIG. 28B is a perspective view of a support with mitered ends within which the female connecting brackets of FIG. 28A have been inserted.
Figure 29:
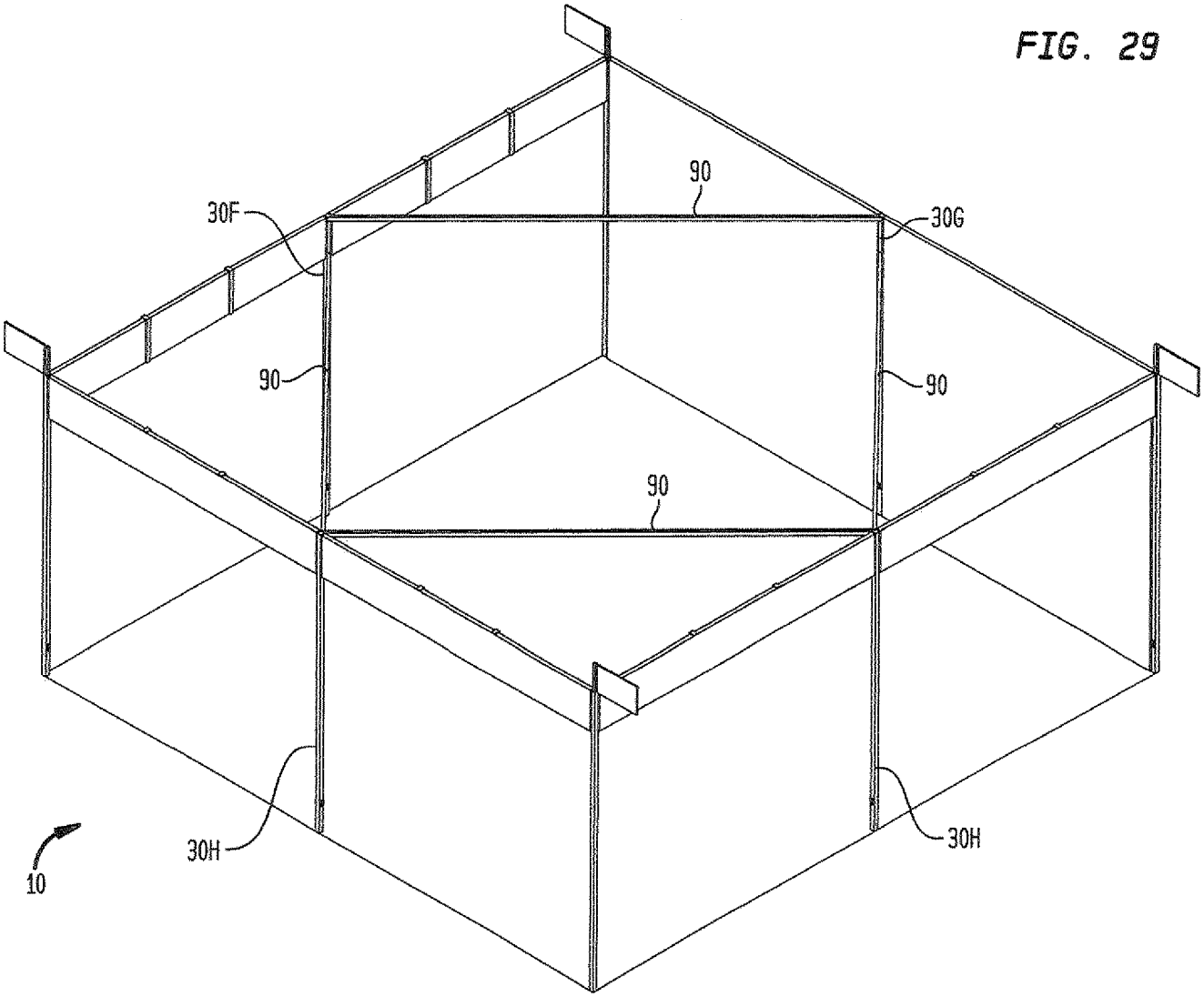
FIG. 29 is a perspective view of a larger embodiment of the modular wall system of the present invention, utilizing additional supports.
Figure 30:
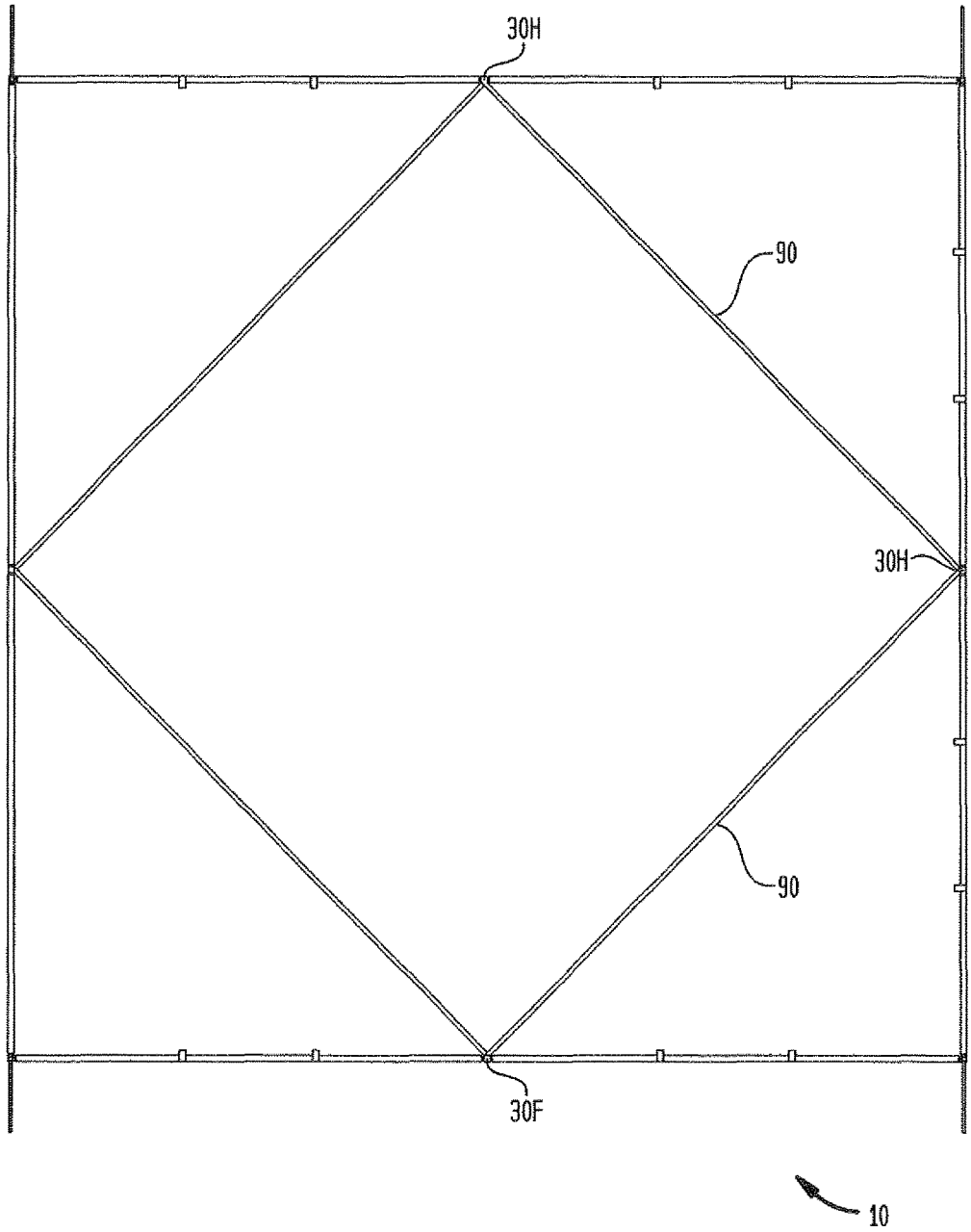
FIG. 30 is a top elevation view of the modular wall system of FIG. 29.

FIGS. 28A and 28B illustrate two female connecting brackets of the type used for joining mitered ends 92 of a support to the columns. As shown in FIGS. 29 and 30, the support 90 is able to extend at a forty-five degree angle from one column 30F to another column 30G. The ribbed securing members 63 are received within the mitered ends of 92 of the support 90 for joining the ends of the support 90 to the columns 30 when the two columns 30C, 30D are not perpendicular one another. A rivet 102, set screw or other conventional fastener may be used for more permanently securing the female connecting bracket 62A into the hollow end 92 of the support 90. A variety of different configurations are contemplated and incorporated herein such that the elongated ribbed securing member 63 may extend outwardly from the female connecting bracket 62A at any possible angle or direction so desired.

Figure 31:
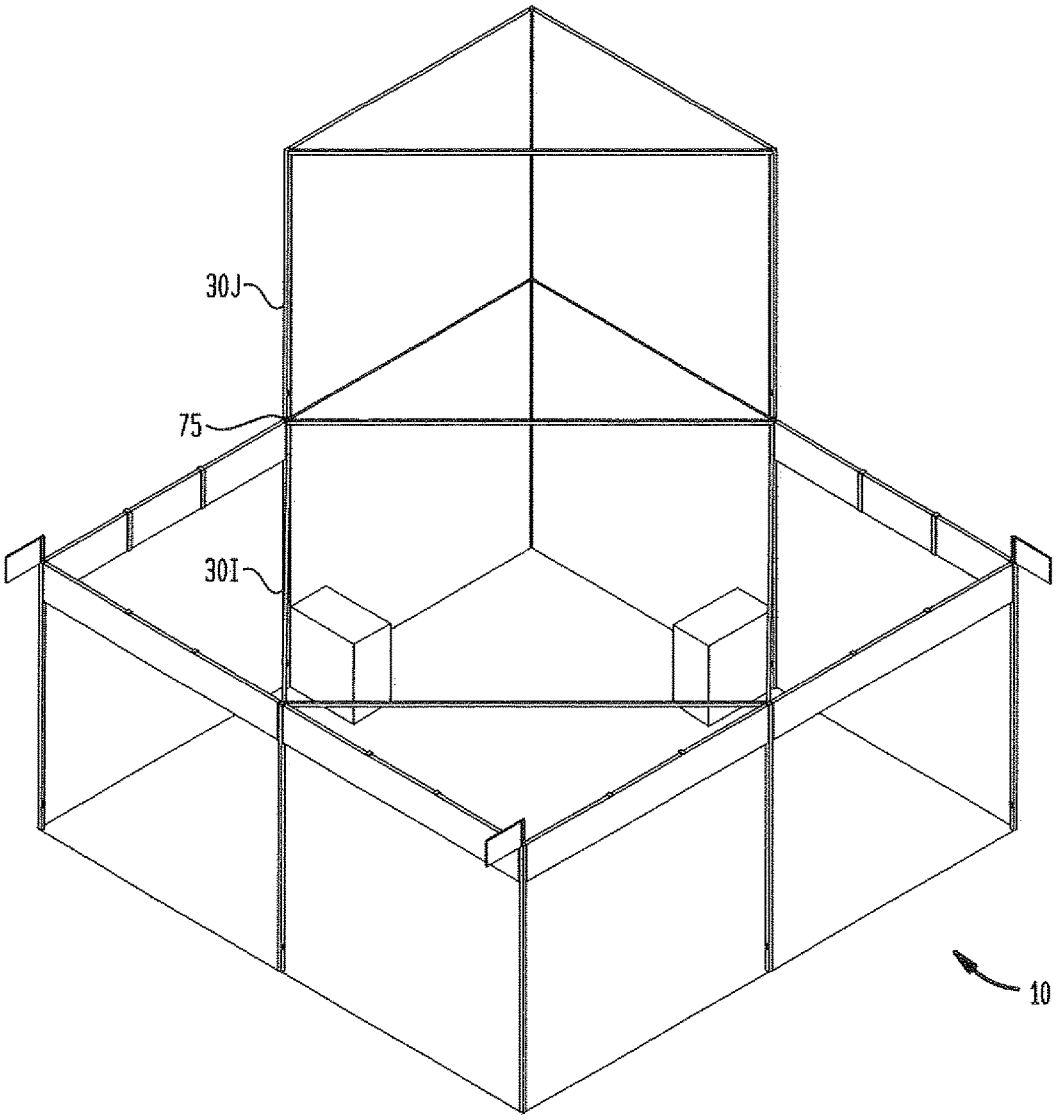
FIG. 31 is a perspective view of a multi-level embodiment of the modular wall system of the present invention.
Figure 32A:
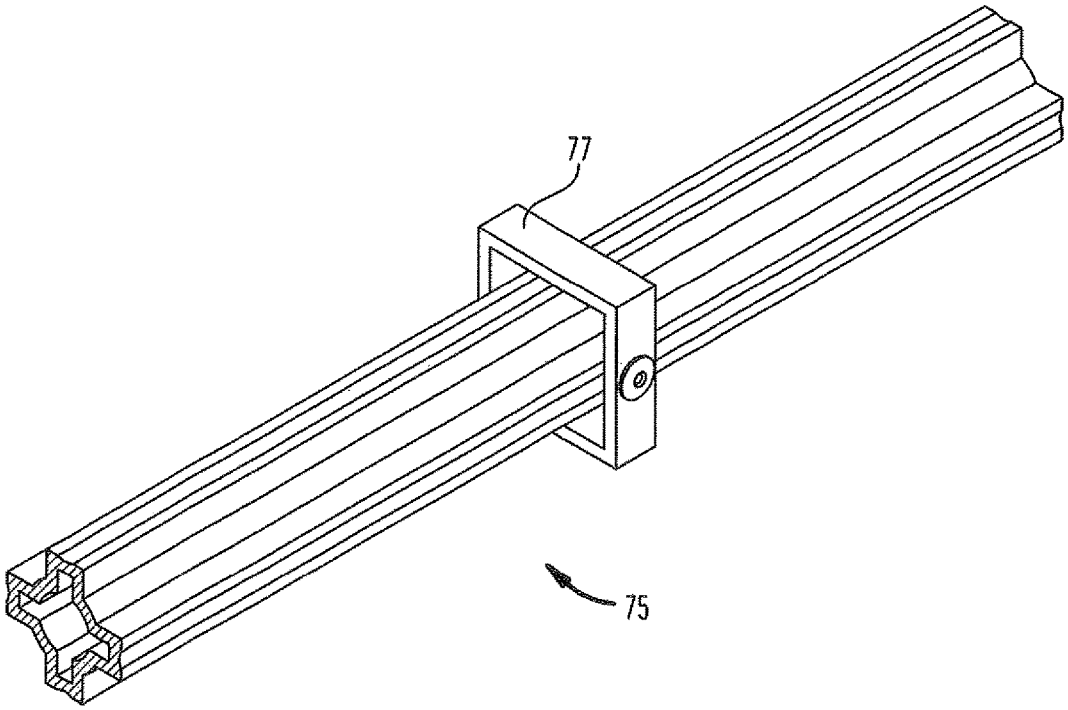
FIG. 32A is a perspective view of a structural member utilized for creating different wall and booth heights, such as is illustrated in FIG. 31.
Figure 32B:
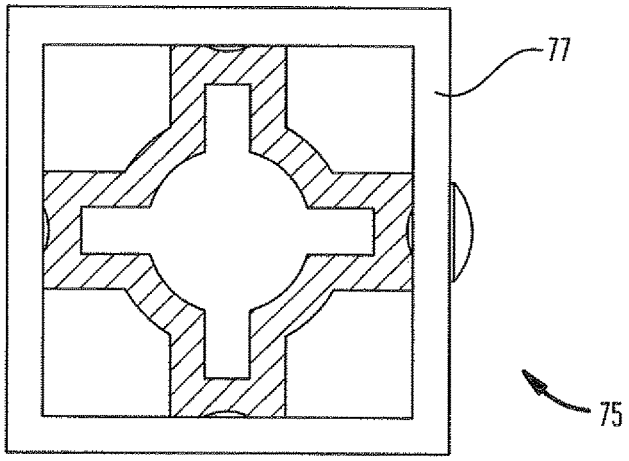
FIG. 32B is an end view of the structural member of FIG. 32A.

FIG. 31 illustrates a multi-level embodiment of the modular wall system of the present invention. The columns 30 extend upwardly at a variety of different heights to create multi-level booth configurations. In the present example, a second level is created above a portion of the first level in order to provide a unique multi-level booth configuration. The upstanding columns are stacked directly on top of one another and coupled together by a structural or joiner member 75. FIGS. 32A and 32B illustrate the structural member 75. The structural member 75 is an elongated member having a generally X-shaped cross-section and includes a substantially square holding ring 77 fastened thereabout. Preferably, the holding ring 77 bisects the length of the structural member 75. The structural member 75 is adapted to be received within the ends 31A, 31B of the hollow columns 30. In particular, the structural member 75 is received within the top end 31A of the hollow column 30I. The bottom end 31B of the stacking column 30J is placed directly above column 30I, such that the bottom end 31B receives the structural member 75 therein. A double length upstanding column is created for providing a second level or tier to the present system 10. A holding ring 77 is positionable between the two columns 311, 31J for providing stability to the second tier.

Figure 33:
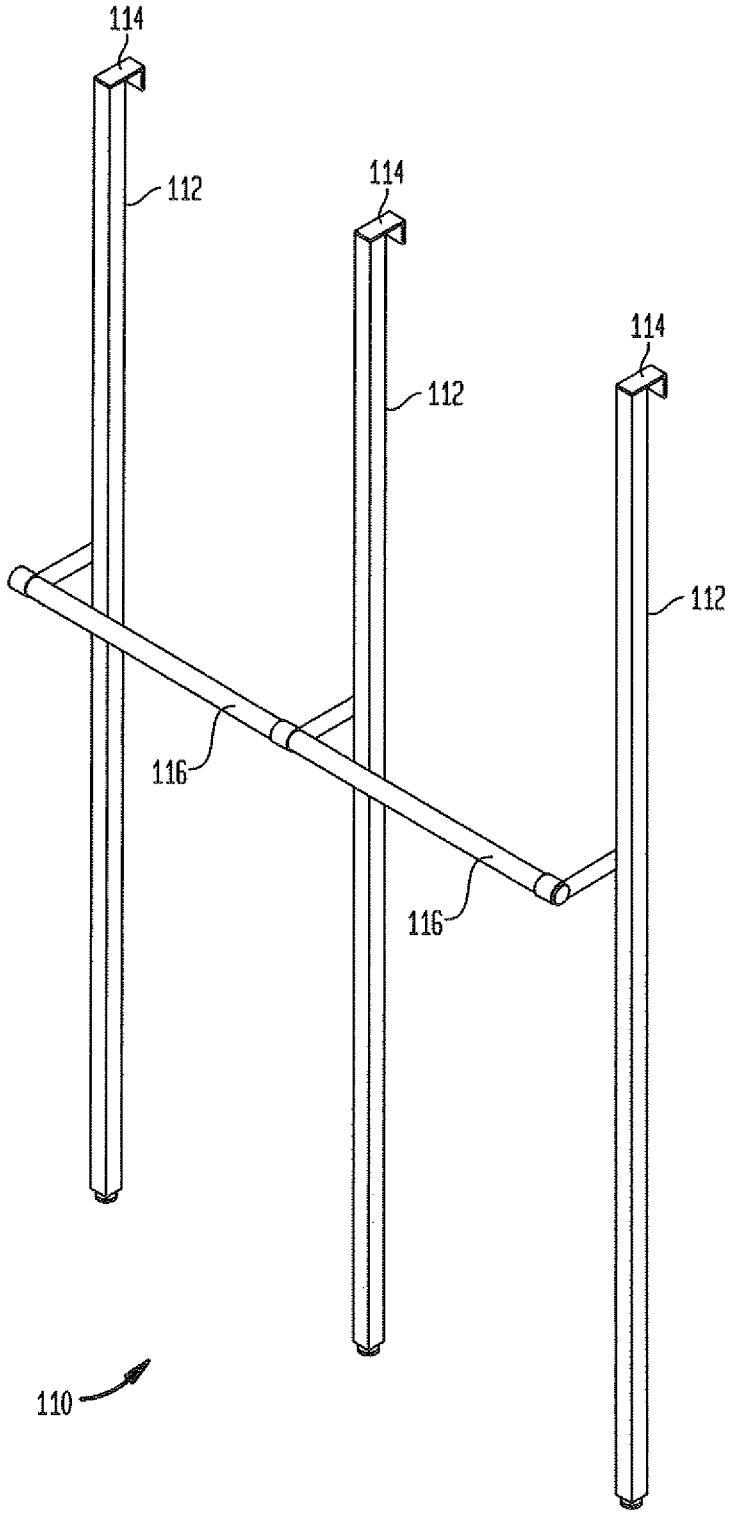
FIG. 33 is a perspective view of an adjustable garment rack accessory adapted for use with the modular wall system of the present invention.

FIGS. 33-38 illustrate a variety of accessories adapted for use with the system 10 of the present invention. FIG. 33 illustrates an adjustable garment rack 110 having at least two vertical support members 112 each having a connecting means 114, preferably hooks, for joining the rack to the system. At least one hanging bar 116 is provided which extends between the supports. Preferably, the hooks 114 extend over the top of the support or frame parts of the panels or headers to join the rack to the system. Preferably, each rack is adjustable in one-inch increments and multiple racks can be combined together for creating longer length units. The racks 110 are most suitable for hanging a variety of garments thereon.

Figure 34:
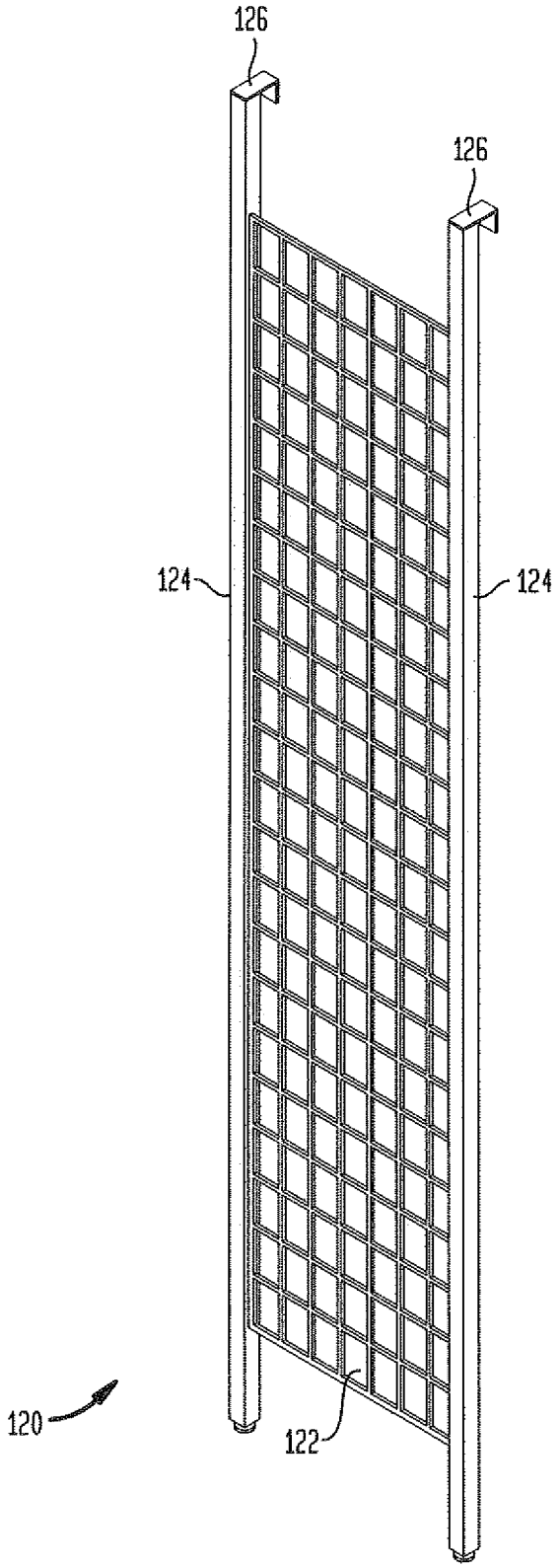
FIG. 34 is a perspective view of a coupling grid accessory adapted for use with the modular wall system of the present invention.

FIG. 34 illustrates a grid 120 adapted for use with system, having a variety of differently apportioned cross bars, or uniformly apportioned cross bars 122, extending between two support members 124. The support members 124 each have a connecting means 126, preferably hooks, for joining the grid to the system. Preferably, the hooks 126 extend over the top of the support or frame parts of the panels or headers to join the rack to the system. The grid 120 is most suitable for attaching a variety of products thereto, including clothing on hangers and the like. The grid may be positioned anywhere within the system, including joining with frame parts of panels or headers.

Figure 35:
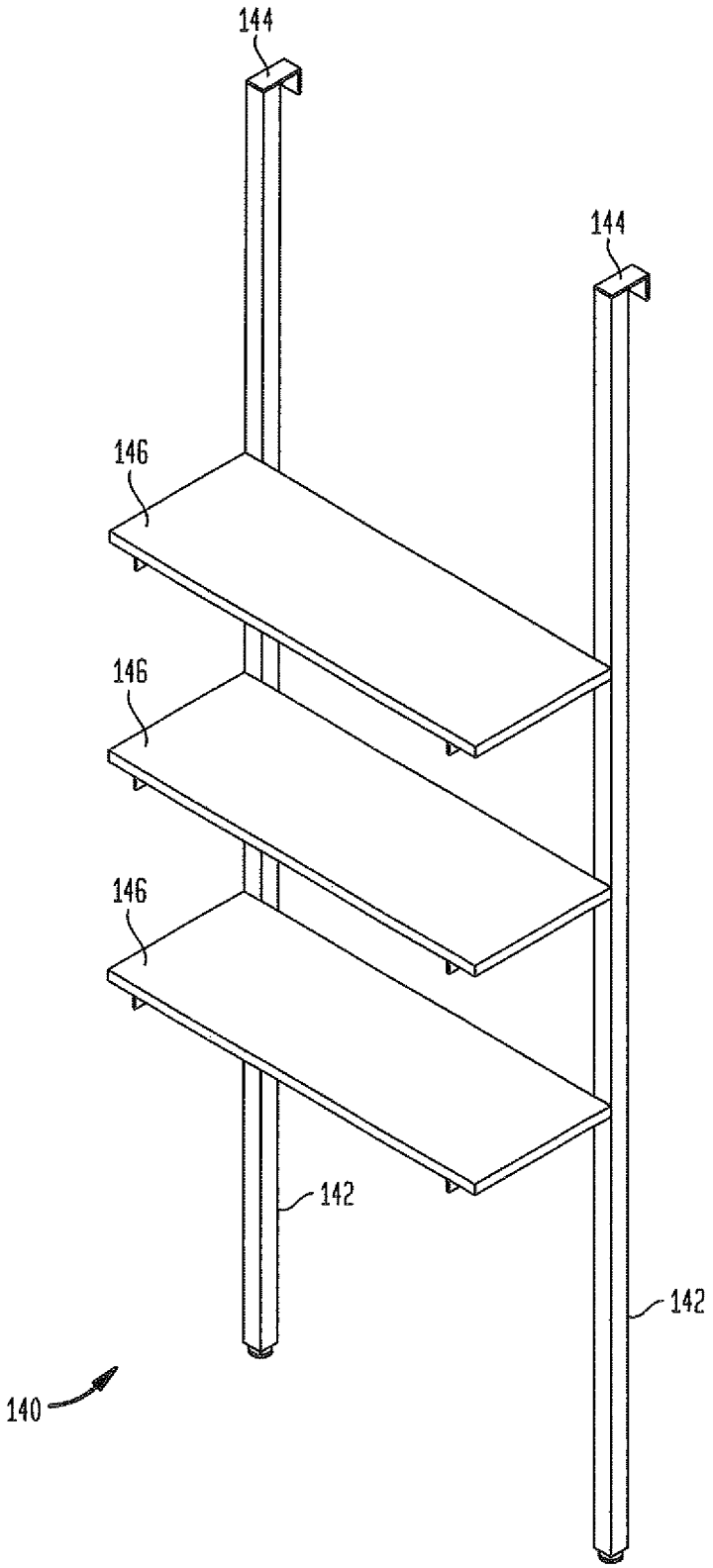
FIG. 35 is a perspective view of a shelving unit accessory adapted for use with the modular wall system of the present invention.

FIG. 35 illustrates a shelving unit 140 adapted for use with the system, having at least two support members 142 and a variety of differently apportioned, or similarly apportioned shelves 146 extending therebetween. The support members 142 each have a connecting means 144, preferably hooks, for joining the grid to the system. Preferably, the hooks 144 extend over the top of the support or frame parts of the panels or headers to join the rack to the system. The shelves 146 are coupled to the support members 142 by an adjustable coupling means that allows the distance between the shelves to be selectively adjustable. The shelves are most suitable for displaying a variety of goods thereon.

Figure 36:
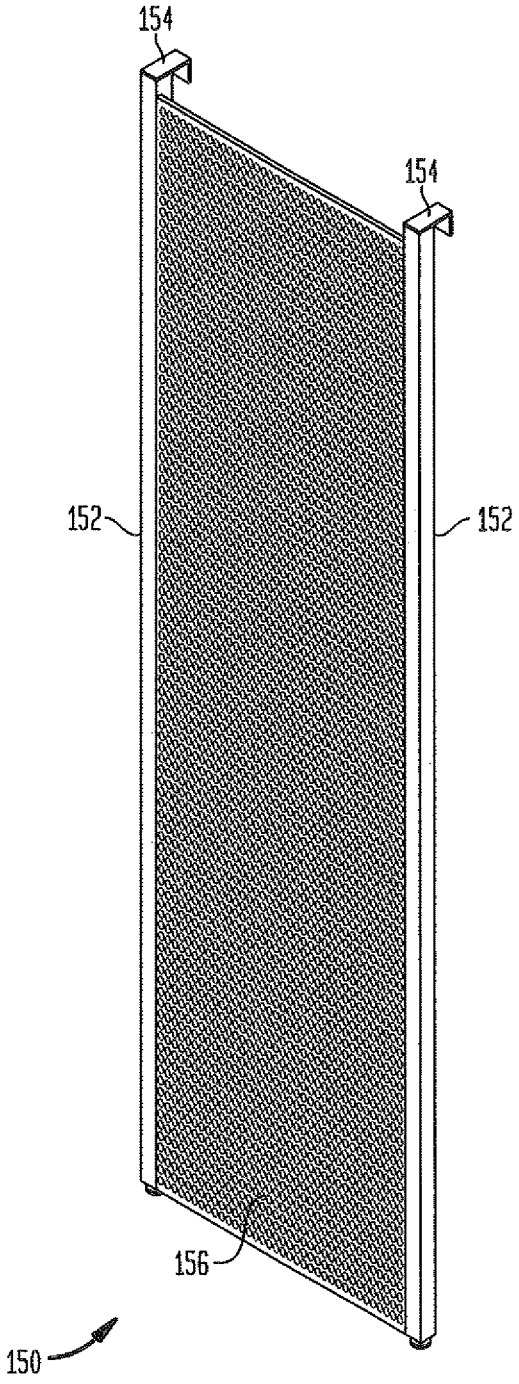
FIG. 36 is a perspective view of a peg-board unit accessory adapted for use with the modular wall system of the present invention.

FIG. 36 illustrates a peg board unit 150 adapted for use with the system, having at least two support members 152 having a peg-board panel 156 extending therebetween. The support members 152 each have a connecting means 154, preferably hooks, for joining the peg-board panel 156 to the system. Preferably, the hooks 154 extend over the top of the support or frame parts of the panels or headers to join the peg-board panel 156 to the system. The peg-board unit 150 may be a single unit or multiple peg-board units may be combined together for create longer length units. The peg-board unit 150 is most suitable for holding a variety of literature or goods thereto by means of a tack or other like fastener.

Figure 37:
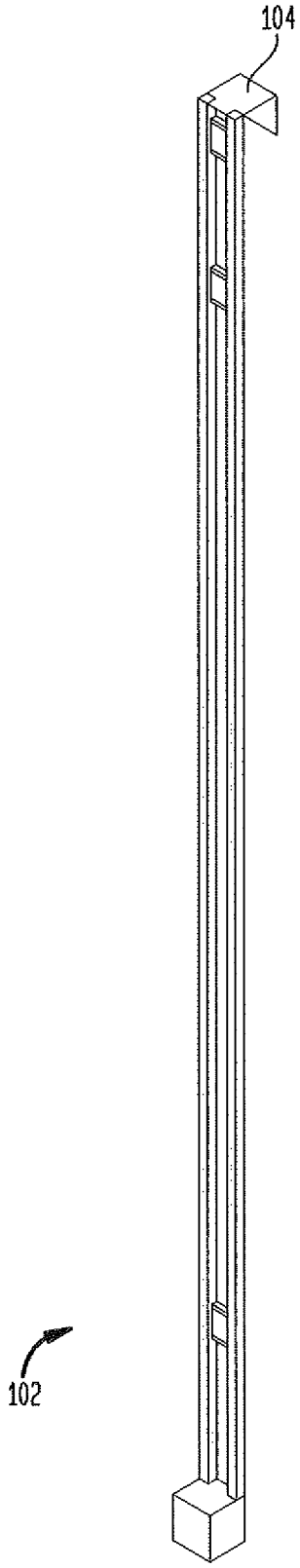
FIG. 37 is a perspective view of an extending member accessory adapted for use with the modular wall system of the present invention.

FIG. 37 illustrates an extending member 102 adapted for use with the system. Member 102 has connecting means 104, preferably a hook, for joining to the system 10. The extending member 102 is an upstanding elongated member that includes one side having at least three outwardly extending male parts 70 thereon for connecting the female parts 62 of wall and header panels. The extending member 102 is able to function as a column by providing support and connection with wall panels and headers, while also providing connection to accessories discussed supra.

Figure 38:
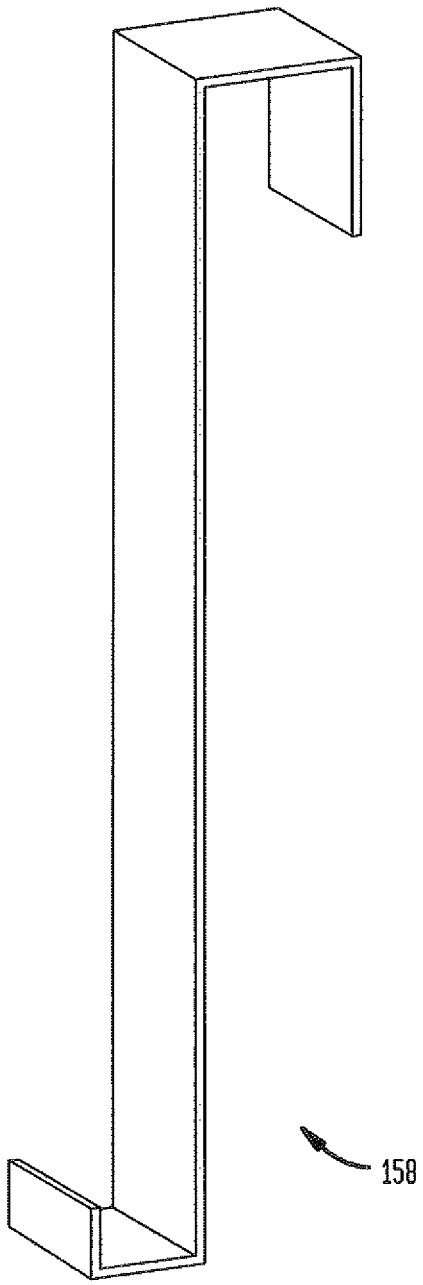
FIG. 38 is a perspective view of a hook accessory adapted for use with the modular wall system of the present invention.

FIG. 38 illustrates a hook 158 adapted for use with the system, which may be coupled to the frame parts of the wall panels, headers or supports for hanging and holding various items thereon.

Figure 39:
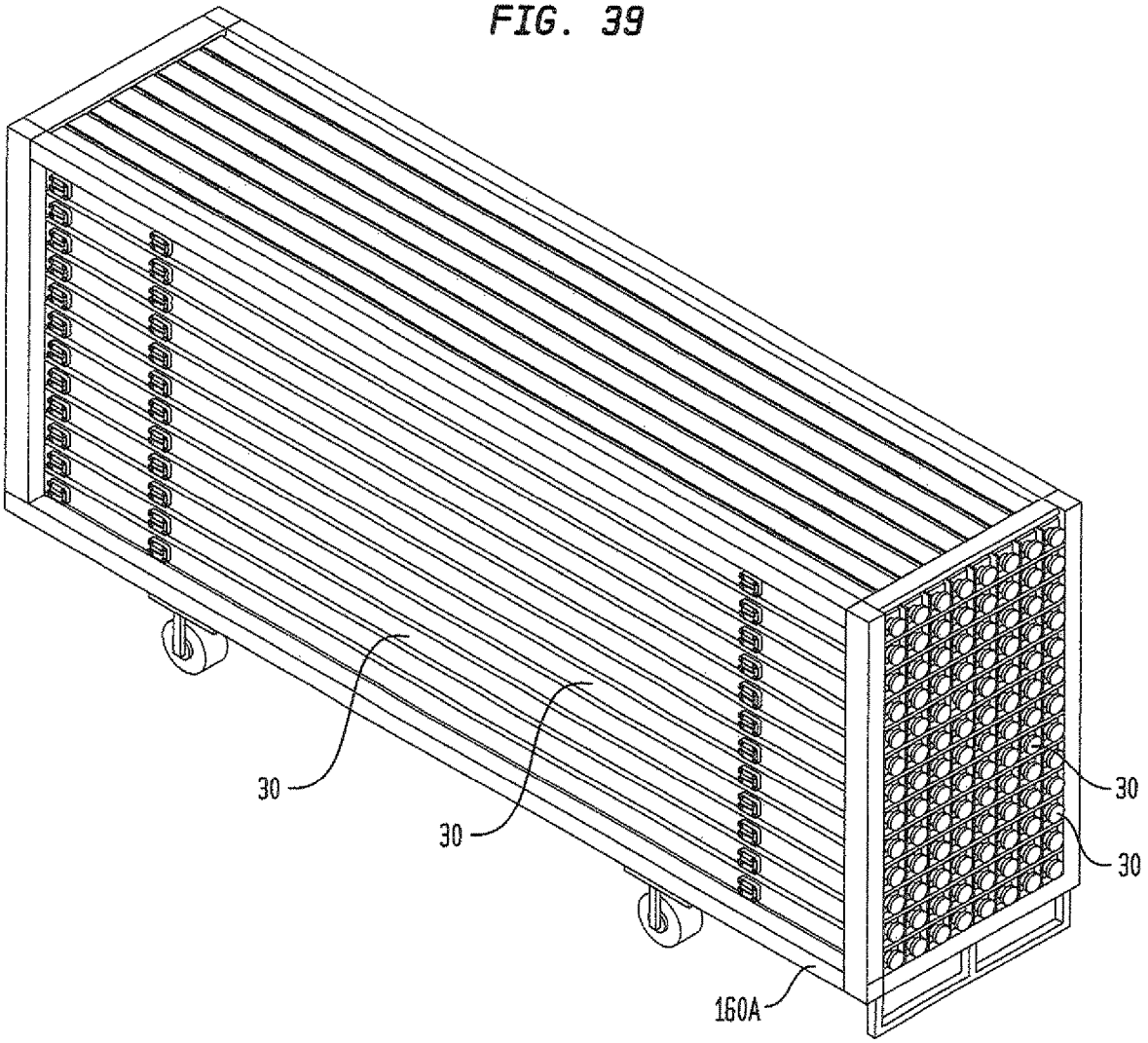
FIG. 39 is a perspective view of a wheeled crate for transporting uniformly stacked columns of the modular system of the present invention.
Figure 40:
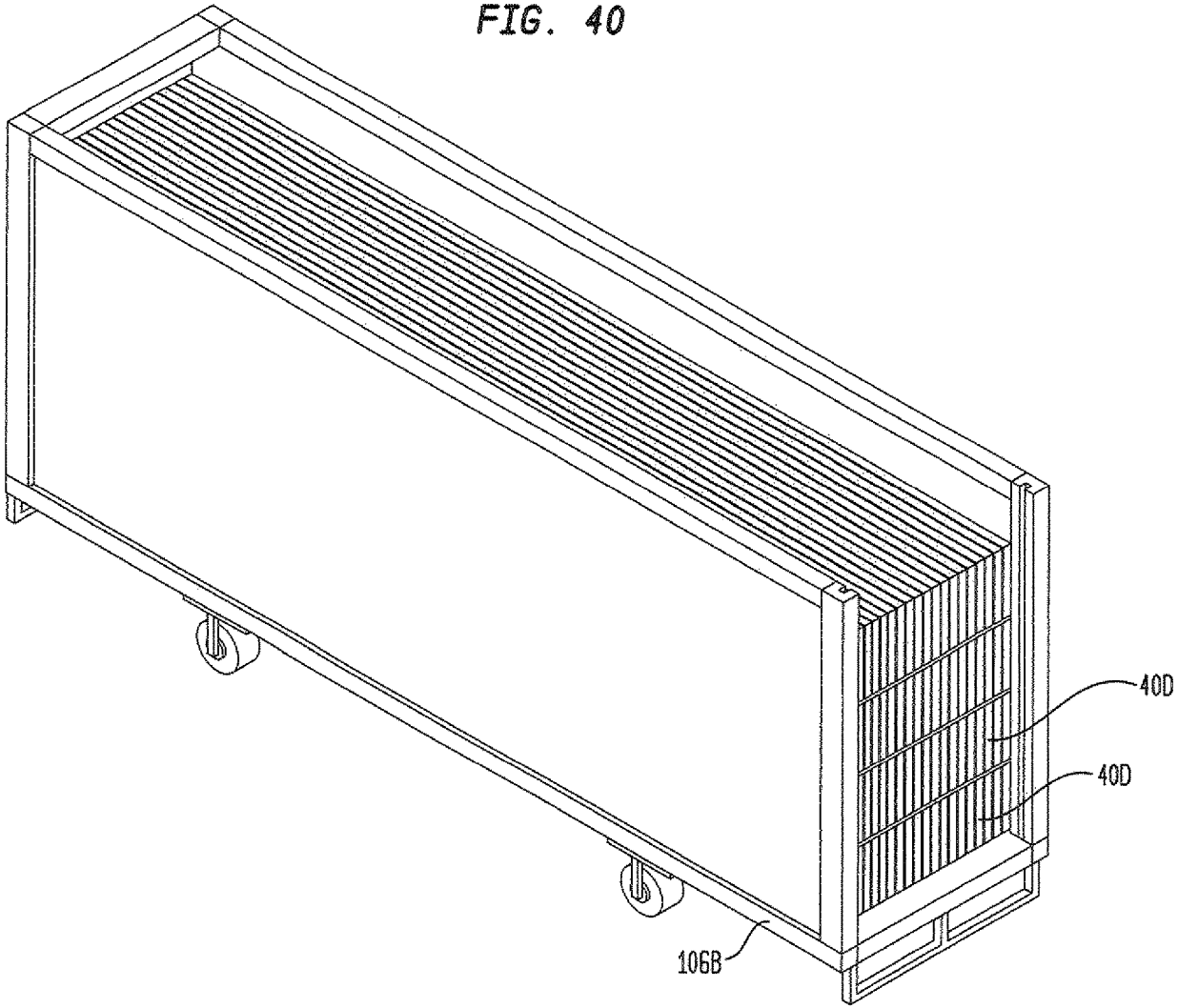
FIG. 40 is a perspective view of a wheeled crate for transporting uniformly stacked headers of the modular system of the present invention.
Figure 41:
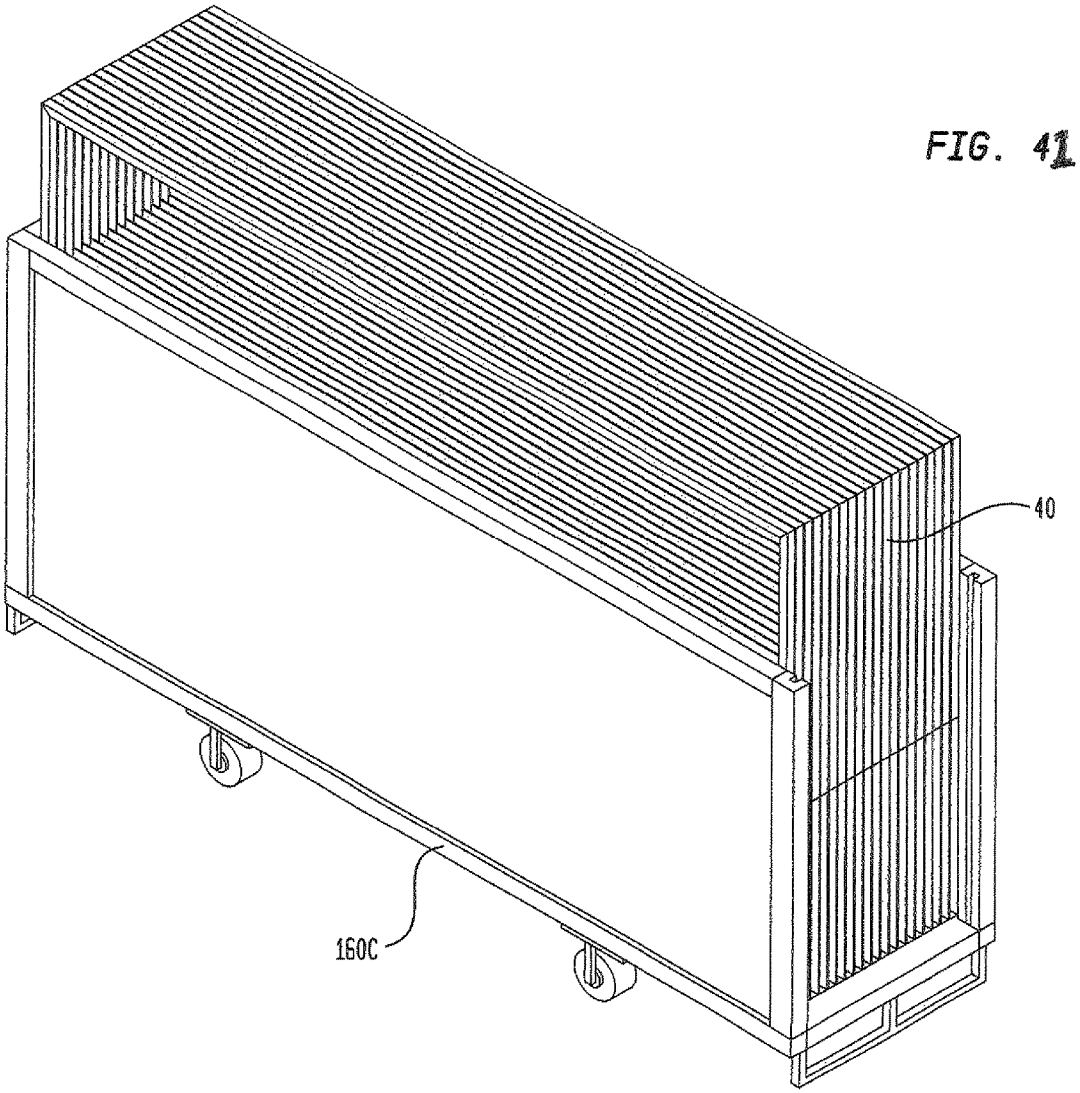
FIG. 41 is a perspective view of a wheeled crate for transporting uniformly stacked wall panels of the modular wall system of the present invention.

FIGS. 39-41 illustrate a wheeled crate 160 for transporting various components of the system. FIG. 39 illustrates the wheeled crate 160A for transporting a plurality of columns 30 therein. Here, the columns 30 are uniformly stacked in a plurality of closely packed rows within the crate. FIG. 40 illustrates the wheeled crate 160B for transporting a plurality of headers 40D therein. Here, the headers are uniformly stacked in four closely packed rows within the wheeled crate 160B. FIG. 41 illustrates the wheeled crate 160C for transporting a plurality of wall panels 40A therein. Herein, the wall panels 40A are uniformly stacked in a single row within the wheeled crate 160C.

The wheeled crates 160 are rolled onto a showroom floor and eliminate the need to dolly various sized bulk crates for setup. Preferably, all crates 160 are color coded for easily identifying contents stored therein.

The wheeled crates 160 are arranged in substantially aligned rows and columns within cargo trucks and are capable of being stacked on top of one another.

Figure 42:
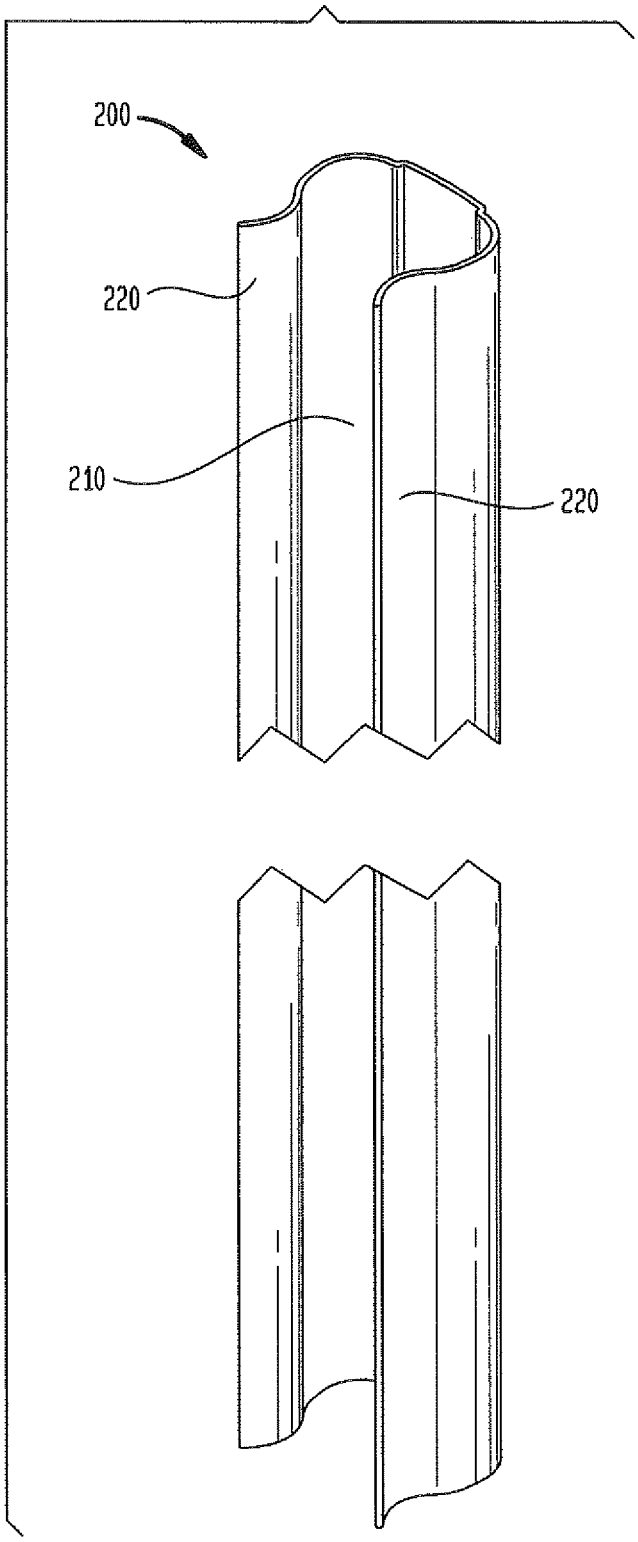
FIG. 42 is a perspective view of an elongated casing adapted for use concealing electrical wire within the modular wall system of the present invention.

FIG. 42 illustrates an elongated casing 200 having an interior channel 210 and ends 220. The channel 210 is beneficial in holding and concealing electrical wires strung or hanging within the modular system. The ends 220 of the casing 200 snap over or wrap around the frame member 44 or column 30 securing the casing in position. The frame member 44 or column 30 is adapted to be received within the interior channel 210 of the casing 200 between the tension forming ends 220, such that electrical wires are concealed within the channel 210 behind the casing and in between the casing and frame member 44 or column 30.

It will now be appreciated that the present invention relates to a modular wall system for exhibitions, including trade shows and the like. The invention is illustrated by example in the drawing figures, and throughout the written description.

It should be understood that numerous variations are possible, while adhering to the inventive concept. Such variations are contemplated as being a part of the present invention.

While only a limited number of preferred embodiments of the present invention have been disclosed for purposes of illustration, it is obvious that many modifications and variations could be made thereto.

It is intended to cover all of those modifications and variations, which fall within the scope of the present invention as defined by the following claims.

I claim:

1. A modular wall system supported on a surface comprising a frame part and an accessory device associated with said frame part, said accessory device having a weight and comprising at least one vertical support member having a top and a bottom and a hook attached to said top of said vertical support member and adapted to be received over said frame part, wherein said bottom of said vertical support member is in contact with the surface upon which said system is supported at the same time as said hook is received over said frame part, said at least one vertical support member extending from said hook to the surface upon which said system is supported in a weight bearing manner to transmit said weight of said accessory device to the surface upon which said system is supported such that said weight of said accessory device is supported by the surface upon which said system is supported.

2. The system of claim 1 wherein said hook is removeably mounted on said frame part.

3. The system of claim 1 wherein said bottom of said vertical support member comprises an adjustable footing in contact with the surface.

4. The system of claim 1 wherein said accessory device is chosen from the group consisting of an adjustable garment rack, a coupling grid, a shelving unit, a peg-board unit and a hook.

5. The system of claim 1 wherein said accessory device comprises two spaced vertical support members having at least one horizontal hanging bar extending between said two vertical support members.

6. The system of claim 1 wherein said accessory device comprises two spaced vertical support members and a plurality of cross-bars extending between said two vertical support members.

7. The system of claim 1 wherein said accessory device comprises with two spaced vertical support members and at least one shelf extending between said two vertical support members.

8. The system of claim 1 wherein said accessory device comprises two spaced vertical support members and a cork board panel extending between said two vertical support members.

9. A modular wall system accessory device for a modular wall system supported on a surface comprising a frame part, said accessory device having a weight and comprising at least one vertical support member having a top and a bottom, a hook attached to said top of said vertical support member, said hook being adapted to be received over said top of said frame part, wherein said bottom of said vertical support member is in contact with the surface upon which said system is supported at the same time as the hook is received over said top of said frame part, said at least one vertical support member extending from said hook to the surface upon which said system is supported in a weight bearing manner to transmit said weight of said accessory device to the surface upon which said system is supported such that said weight of said accessory device is supported by the surface upon which said system is supported.

10. A modular wall system accessory device for a modular wall system supported on a surface comprising a frame part, said accessory device having a weight and comprising at least two spaced vertical support members and a cross member extending between said vertical support members, each of said vertical support members having a top and a bottom, a hook attached to said top of each said vertical support members, said hooks being adapted to be received over said top of said frame part, wherein said bottom of each of said vertical support members is in contact with the surface upon which said system is supported at the same time that said hook is received over the top of said frame part, each of said vertical support members extending from said hook to which said vertical support member is attached to the surface upon which said system is supported in a weight bearing manner to transmit said weight of said accessory device to the surface upon which said system is supported such that said weight of said accessory device is supported by the surface upon which said system is supported.

* * * * *